US010907433B2

(12) United States Patent
Thomas

(10) Patent No.: US 10,907,433 B2
(45) Date of Patent: Feb. 2, 2021

(54) PROTECTIVE CAP ASSEMBLY FOR SUBSEA EQUIPMENT

(71) Applicant: Sean P. Thomas, Houston, TX (US)

(72) Inventor: Sean P. Thomas, Houston, TX (US)

( * ) Notice: Subject to any disclaimer, the term of this patent is extended or adjusted under 35 U.S.C. 154(b) by 0 days.

(21) Appl. No.: 16/395,165

(22) Filed: Apr. 25, 2019

(65) Prior Publication Data

US 2019/0330951 A1 Oct. 31, 2019

Related U.S. Application Data

(60) Provisional application No. 62/663,858, filed on Apr. 27, 2018.

(51) Int. Cl.

| | |
|---|---|
| ***E21B 33/035*** | (2006.01) |
| ***E21B 34/04*** | (2006.01) |
| ***E21B 33/076*** | (2006.01) |
| *E21B 41/02* | (2006.01) |

(52) U.S. Cl.

CPC ..... *E21B 33/035* (2013.01); *E21B 33/076* (2013.01); *E21B 34/04* (2013.01); *E21B 41/02* (2013.01)

(58) Field of Classification Search

CPC ..... E21B 33/035; E21B 33/076; E21B 41/02
See application file for complete search history.

(56) References Cited

U.S. PATENT DOCUMENTS

| | | | | |
|---|---|---|---|---|
| 6,494,257 | B2 * | 12/2002 | Bartlett | E21B 33/043 166/86.2 |
| 6,845,815 | B2 * | 1/2005 | Hergarden | E21B 33/037 166/75.13 |
| 7,621,338 | B2 * | 11/2009 | Wenham | E21B 33/035 166/343 |
| 7,637,325 | B2 * | 12/2009 | Goonetilleke | E21B 33/037 166/368 |
| 7,677,319 | B2 * | 3/2010 | Baskett | E21B 33/035 166/360 |
| 8,087,465 | B2 * | 1/2012 | Huang | E21B 33/037 166/339 |
| 8,230,928 | B2 * | 7/2012 | Cuiper | E21B 33/035 166/338 |
| 8,235,124 | B2 * | 8/2012 | Cuiper | E21B 19/002 166/365 |
| 8,403,060 | B2 * | 3/2013 | Given | E21B 33/043 166/368 |
| 8,739,883 | B2 * | 6/2014 | Aarnes | E21B 23/02 166/368 |

(Continued)

*Primary Examiner* — Aaron L Lembo
(74) *Attorney, Agent, or Firm* — Nolte Lackenbach Siegel

(57) ABSTRACT

A protective cap assembly for a subsea equipment mandrel or hub, including a protective cap body with a top plate and a cylindrical sidewall. The protective cap body may further include a primary inlet port, a first annular groove, a secondary inlet port, a second annular groove, and one or more secondary outlet ports. A primary seal may be disposed in the first annular groove to sealingly engage the mandrel or hub, and a secondary seal may be disposed in the second annular groove to sealingly engage the mandrel or hub. The protective cap assembly may further define at least in part primary and secondary chambers configured to fluidly communicate, and the secondary chamber configured to fluidly communicate directly or indirectly with the external subsea environment.

25 Claims, 18 Drawing Sheets

(56) References Cited

U.S. PATENT DOCUMENTS

| | | | | |
|---|---|---|---|---|
| 8,813,853 | B1 * | 8/2014 | Peterson | E21B 33/037 166/351 |
| 8,939,212 | B1 * | 1/2015 | Arning | E21B 33/0375 166/335 |
| 9,534,466 | B2 * | 1/2017 | Pathak | E21B 33/035 |
| 9,897,207 | B2 * | 2/2018 | McClendon | F04B 53/007 |
| 9,926,760 | B1 * | 3/2018 | Santilli | E21B 41/04 |
| 2006/0076141 | A1 * | 4/2006 | Bartlett | E21B 33/038 166/368 |
| 2007/0289747 | A1 * | 12/2007 | Shaw | E21B 43/128 166/368 |
| 2014/0158367 | A1 * | 6/2014 | Stokes | E21B 29/005 166/368 |

* cited by examiner

PROTECTIVE CAP ASSEMBLY FOR SUBSEA EQUIPMENT

CROSS-REFERENCE TO RELATED APPLICATIONS

This application claims the benefit of U.S. Prov. Appl. No. 62/663,858, filed Apr. 27, 2018, the content of which is incorporated herein by reference in its entirety to the extent consistent with the present application.

BACKGROUND

Subsea hydrocarbon wells are typically drilled and constructed in subsea earthen formations from mobile offshore drilling units using subsea wellhead systems. FIG. 1 illustrates a cross sectional view of an example subsea wellhead assembly 100 having an upper portion, illustrated as a mandrel 110, known to those of ordinary skill in the art. As shown, the subsea wellhead assembly 100 includes a high pressure wellhead housing 102, a low pressure wellhead housing 104, and conductor pipe 106 extending from the low pressure wellhead housing 104.

Construction of a hydrocarbon well generally starts by installing the low pressure wellhead housing 104 and conductor pipe 106 in the seabed 108 via drilling, jetting or pile driving processes. During subsequent drilling operations, varying casing strings and additional wellhead components including the high pressure wellhead housing 102 are installed in the hydrocarbon well. The high pressure wellhead housing 102 is configured to carry the loads transferred to the seabed 108 and the pressures contained within the hydrocarbon well. During drilling of the hydrocarbon well, the high pressure wellhead housing 102 is connected to a blowout preventer (BOP) device (not shown) using a wellhead connector (not shown). After drilling is completed and in preparation for production of hydrocarbons, a production system (not shown) will be connected to the high pressure wellhead housing 102 using another wellhead connector (not shown).

The mandrel 110 may include structural features and sealing surfaces that interface with the appropriate wellhead connector. Generally, these structural features and sealing surfaces include one or more circumferential grooves (four shown 112) that define one or more angled shoulder surfaces (four shown 113) formed in a main outer circumferential surface 114 of the mandrel 110 to provide connection means to the wellhead connector. The mandrel 110 further defines an upper outer circumferential surface 115 above the circumferential grooves 112 and one or more conical sealing surfaces 116 near the top of an inner circumferential surface 118 of the mandrel. The conical sealing surfaces 116 are typically referred to as ring gasket sealing surfaces and are configured to interface with a metal ring gasket (not shown) and wellhead connector to seal liquids and gases at varying pressures. The mandrel 110 further includes one or more top faces (one shown 120). The inner circumferential surface 118 of the high pressure wellhead housing 102 may be further defined by one or more sealing surfaces 130, locking grooves 132, and load shoulders 134, located below the conical sealing surface 116. Casing hangers, tubing hangers, lockdown sleeves, and similar components (not shown) may be landed, locked and sealed to the inner circumferential surface 118 during well construction, with each respective component defining additional sealing surfaces and locking features within the bore of those components.

FIG. 2 illustrates a cross sectional view of an upper portion for a subsea wellhead, subsea tree, or similar subsea equipment, illustrated as a hub 210, known to those of ordinary skill in the art. The hub 210 has an outward step above the main outer circumferential surface 214 that defines one large, angled shoulder surface 113 and an upper outer circumferential surface 115. Similar to the mandrel 110, the hub 210 further includes one or more conical sealing surfaces (one shown 116) near the top of an inner circumferential surface 118 of the hub and one or more top faces (two shown 120) of the hub.

FIG. 3 illustrates a cross sectional view of an upper portion for a subsea wellhead, subsea tree, or similar subsea equipment, illustrated as a dual hub 310, known to those of ordinary skill in the art. The dual hub 310 includes a main outer circumferential surface 114 that defines two circumferential grooves 112, two large angled shoulder surfaces 113, and an upper outer circumferential surface 115. Similar to the mandrel 110 and the hub 210, the dual hub 310 further includes one or more conical sealing surfaces (one shown 116) near the top of an inner circumferential surface 118 of the hub and one or more top faces (two shown 120). Similar mandrel and hub designs are used for pressure-containing connections for subsea trees, subsea manifolds, subsea pipelines, etc., in varying sizes ranging from 2 inch nominal through 48 inch nominal, which may be referred to generally as subsea equipment mandrels and hubs.

During construction of the hydrocarbon well, there are a number of circumstances where an oil company or drilling contractor may temporarily halt drilling or construction activities, an event commonly referred to as a temporary abandonment. Such a temporary abandonment may be a fairly short period lasting weeks or months, or alternatively the temporary abandonment may last several years. Left unprotected during the temporary abandonment, those of skill in the art will appreciate that the mandrel 110 may be susceptible to damage from external objects and, in addition, corrosion and deposits resulting from the exposure of the mandrel 110 to the corrosive seawater and other damaging elements of the subsea environment. For example, corrosion and/or deposits may form on the conical sealing surface 116 resulting in an inability to form a seal at the interface with the metal ring gasket of the wellhead connector to seal liquids and gases at varying pressures. In addition, corrosion or deposits may form on the internal sealing surfaces 130 and locking features 132 of the inner circumferential surface 118, or the internal sealing surfaces and locking features of the components (not shown) installed to the inner circumferential surface 118. Further, corrosion or deposits may form on the angled shoulder surfaces 113 on the exterior portion of the mandrel 110, resulting in an inability to provide a suitable connection means to the wellhead connector.

Accordingly, it has been a common practice in the offshore industry to install a temporary, external protective cap assembly to the mandrel or hub of a subsea wellhead assembly 100, subsea tubing head spool, or subsea tree during the temporary abandonment of a hydrocarbon well. These subsea protective cap assemblies are typically referred to as corrosion caps, debris caps, trash caps, or temporary abandonment caps. In addition to physically preventing external objects and debris from contacting the mandrel or hub and entering the bore 122, the protective cap assemblies may be configured to allow for the injection and retention of a corrosion inhibitor fluid to reduce corrosion, deposits, and related damage to the internal sealing surfaces and locking features of the mandrel or hub. Protective cap assemblies are also typically installed to the mandrel or hub of a subsea production tree for long-term installation. Protective cap assemblies for subsea trees may be very similar to the subsea wellhead cap, or may have a specialized configuration depending on the subsea tree design. Similar protective cap assemblies in varying sizes may be used for other subsea equipment mandrels and hubs for subsea trees, subsea manifolds, subsea jumpers, subsea pipelines, and similar subsea equipment.

Protective cap assemblies have traditionally been constructed from steel. As the weight of the protective cap assemblies constructed from steel may often exceed six hundred pounds, these protective cap assemblies are typically installed by a drilling rig using drill pipe or a wireline hoist. Although these steel-constructed protective cap assemblies are generally inexpensive to design and manufacture, the costly expense of drilling rig time to install such protective cap assemblies has led to a need for an improved protective cap assembly. Accordingly, a more recent development has been the utilization of lightweight protective cap assemblies that can be installed using a remotely operated vehicle (ROV), which avoids the costly expense of drilling rig time to install the protective cap assembly. To allow for ROV installation, the protective cap assembly is typically limited to about 150 to 200 pounds maximum weight as provided with the protective cap assembly immersed in seawater.

The slight internal pressures in the protective cap assembly created during injection of corrosion inhibitor fluid may create substantial lifting forces which may easily exceed the weight of the protective cap assembly such that the cap may try to lift off the mandrel. If the cap is coupled to the mandrel with a locking feature, any clearances in the connection means of the protective cap assembly to the mandrel may allow the protective cap to lift slightly, and may compromise the seal between the protective cap assembly and the mandrel 110, and allow the corrosion inhibitor fluid to drain from the cap. Accordingly, in such instances, corrosive seawater may be permitted to contact the sealing surfaces and locking features of the inner circumferential surface 118 of the mandrel 110, thereby damaging these sealing surfaces and locking features.

What is needed, therefore, is a protective cap assembly capable of being coupled to a subsea equipment mandrel or hub while maintaining a sealing relationship with the mandrel or hub and receiving a corrosion inhibitor fluid therein to prevent corrosion and/or the formation of deposits on the mandrel or hub.

SUMMARY

Embodiments of the disclosure may provide a protective cap assembly for a subsea equipment mandrel or hub disposed in a subsea environment. The protective cap assembly may include a protective cap body, a primary seal, a secondary seal, a primary inlet check valve, one or more locking assemblies, and a primary outlet check valve. The protective cap body may include a top plate, a cylindrical sidewall, a primary inlet port, a first annular groove, a secondary inlet port, a second annular groove, and one or more secondary outlet ports. The top plate may define an inner surface. The cylindrical sidewall may be coupled to or integral with the top plate and have an inner cylindrical surface configured to be disposed over the mandrel or hub. The primary inlet port may be defined by the protective cap body and configured to fluidly communicate with a fluid source. The first annular groove may be defined by the upper portion of the protective cap body outwards or below the primary inlet port. The secondary inlet port may be defined by the protective cap body outwards or below the first annular groove. The second annular groove may be defined by the cylindrical sidewall below the secondary inlet port. The one or more secondary outlet ports may be defined by the cylindrical sidewall above the second annular groove. The primary seal may be disposed in the first annular groove to sealingly engage the mandrel or hub and may be configured to isolate an internal bore of the mandrel or hub from the subsea environment. The primary seal and the top plate as disposed on the mandrel or hub may form at least in part a primary chamber fluidly coupled with the primary inlet port and configured to receive the internal bore therein. The secondary seal may be disposed in the second annular groove to sealingly engage the mandrel or hub and may be configured to isolate a plurality of circumferential grooves formed in an outer circumferential surface of the mandrel from the subsea environment. The primary seal, the secondary seal, and the inner cylindrical surface as disposed over the outer circumferential surface may define at least in part a secondary chamber configured to receive the plurality of circumferential grooves therein. The primary inlet check valve may be fluidly coupled to the primary inlet port and configured to selectively prevent fluid from entering the primary chamber from the fluid source. The one of more locking assemblies may be mounted to the protective cap body to couple the protective cap assembly to the subsea equipment mandrel or hub. The primary outlet check valve may be fluidly coupled to the primary chamber and configured to selectively prevent fluid from exiting the primary chamber. The primary chamber and the secondary chamber may be configured to fluidly communicate, and the secondary chamber may be configured to fluidly communicate with the external subsea environment, such that a portion of the fluid removable from the primary chamber may be directed to the secondary chamber, and a portion of the fluid removable from the secondary chamber may be dischargeable to the subsea environment.

Embodiments of the disclosure may further provide a protective cap assembly for a subsea equipment mandrel or hub disposed in a subsea environment. The protective cap assembly may include a protective cap body, a primary seal, a primary inlet check valve, one or more locking assemblies, and a primary outlet check valve. The protective cap body may include a top plate, a cylindrical sidewall and a primary inlet port. The top plate may define an inner surface. The cylindrical sidewall may be coupled to or integral with the top plate and have an inner cylindrical surface configured to be disposed over the mandrel or hub. The primary inlet port may be defined by the protective cap body and configured to fluidly communicate with a fluid source. The primary seal may be coupled to the protective cap body outwards or below the primary inlet port to sealingly engage the mandrel or hub and may be configured to isolate an internal bore of the mandrel or hub from the subsea environment. The primary seal and the top plate as disposed on the mandrel or hub may form at least in part a primary chamber fluidly coupled with the primary inlet port and configured to receive the internal bore therein. The primary inlet check valve may be fluidly coupled to the primary inlet port and configured to selectively prevent fluid from entering the primary chamber from the fluid source. The one of more locking assemblies may be mounted to the protective cap body to couple the protective cap assembly to the subsea equipment mandrel or hub. The primary outlet check valve may be fluidly coupled to the primary chamber and configured to selectively prevent fluid from exiting the primary chamber. The primary outlet check valve may include a valve body coupled to a valve closure having threads, a biasing member, a piston, a threaded adjusting component, and a threaded locking component. The valve body and the valve closure as coupled may define a valve chamber. The biasing member may be disposed in the valve chamber. The piston may be axially displaceable in the valve chamber via the biasing member and configured to allow fluid to flow through the primary outlet check valve once a pressure applied thereto exceeds a predetermined pressure. The threaded adjusting component may be disposed at least partly within the valve chamber and configured to set the predetermined pressure for which the piston allows fluid to flow through the primary outlet check valve. The threaded locking component may be configured to prevent the threaded adjusting component from moving once the predetermined pressure is determined.

Embodiments of the disclosure may further provide a protective cap assembly configured to be coupled to a subsea equipment mandrel or hub with an internal bore via an ROV. The protective cap assembly may include a protective cap body, a primary seal, a secondary seal, a primary inlet check valve, and one or more locking assemblies. The protective cap body may include a top plate, a cylindrical sidewall, a primary inlet port, a secondary inlet port, a first annular groove, and one or more secondary outlet ports. The cylindrical sidewall may be coupled to or integral with the top plate and configured to be disposed over the mandrel or hub. The primary inlet port may be defined by the protective cap body and configured to fluidly communicate with a fluid source. The secondary inlet port may be defined by an upper portion of the protective cap body and outwards or below the primary inlet port. The first annular groove may be defined by an inner cylindrical surface of the cylindrical sidewall of the protective cap body and below the secondary inlet port. The one or more secondary outlet ports may be defined by the cylindrical sidewall above the first annular groove. The primary seal may be mounted internally to the protective cap body outwards or below the primary inlet port and inwards or above the secondary inlet port and configured to sealingly engage the mandrel or hub and to isolate an internal bore of the mandrel or hub from the external subsea environment. The primary seal and the top plate as disposed on the mandrel or hub may form at least in part a primary chamber fluidly coupled with the primary inlet port and configured to receive the internal bore of the mandrel or hub therein. The primary inlet check valve may be fluidly coupled to the primary inlet port and configured to selectively prevent fluid from entering the primary chamber from the fluid source. The one of more locking assemblies may be mounted to the protective cap body to couple the protective cap assembly to the subsea equipment mandrel or hub. The secondary seal may be disposed in the first annular groove and configured to isolate a plurality of circumferential grooves formed in an outer circumferential surface of the mandrel from the external subsea environment. The primary seal, the secondary seal, and the inner cylindrical surface as disposed over the outer circumferential surface may define at least in part a secondary chamber configured to receive the plurality of circumferential grooves therein. The primary chamber and the secondary chamber may be configured to fluidly communicate, and the secondary chamber may be configured to fluidly communicate with the external subsea environment via the one or more secondary outlet ports, such that a portion of the fluid removable from the primary chamber may be directed to the secondary chamber, and a portion of the fluid removable from the secondary chamber may be dischargeable to the subsea environment.

Embodiments of the disclosure may further provide a protective cap assembly for a subsea equipment mandrel or hub disposed in a subsea environment. The protective cap assembly may include a protective cap body, a primary seal, a secondary seal, a primary inlet check valve, and one or more locking assemblies. The protective cap body may include a top plate, a cylindrical sidewall, a primary inlet port, a secondary inlet port, a first annular groove, one or more secondary outlet ports, and one or more tertiary inlet ports. The cylindrical sidewall may be coupled to or integral with the top plate and configured to be disposed over the mandrel or hub. The primary inlet port may be defined by the protective cap body and configured to fluidly communicate with a fluid source. The secondary inlet port may be defined by an upper portion of the protective cap body and outwards or below the primary inlet port. The first annular groove may be defined by an inner cylindrical surface of the cylindrical sidewall of the protective cap body and below the secondary inlet port. The one or more secondary outlet ports may be defined by the cylindrical sidewall above the first annular groove. The one or more tertiary inlet ports may be defined by the cylindrical sidewall below the first annular groove. The primary seal may be mounted internally to the protective cap body outwards or below the primary inlet port and inwards or above the secondary inlet port and configured to sealingly engage the mandrel or hub and to isolate an internal bore of the mandrel or hub from the external subsea environment. The primary seal and the top plate as disposed on the mandrel or hub may form at least in part a primary chamber fluidly coupled with the primary inlet port and configured to receive the internal bore of the mandrel or hub therein. The primary inlet check valve may be fluidly coupled to the primary inlet port and configured to selectively prevent fluid from entering the primary chamber from the fluid source. The one of more locking assemblies may be mounted to the protective cap body to couple the protective cap assembly to the subsea equipment mandrel or hub. The secondary seal may be disposed in the first annular groove and configured to isolate a plurality of circumferential grooves formed in an outer circumferential surface of the mandrel from the external subsea environment. The primary seal, the secondary seal, and the inner cylindrical surface as disposed over the outer circumferential surface may define at least in part a secondary chamber configured to receive the plurality of circumferential grooves therein. The secondary seal and the inner cylindrical surface as disposed over the outer circumferential surface of the mandrel may define at least in part an annular cavity having a top portion and a bottom portion. The bottom portion of the annular cavity may be open to seawater and the top portion may be enclosed by the secondary seal. The primary chamber and the secondary chamber may be configured to fluidly communicate. The secondary chamber and annular cavity may be configured to fluidly communicate, with the annular cavity being open at the bottom to the external subsea environment, such that a portion of the fluid removable from the primary chamber may be directed to the secondary chamber, a portion of the fluid removable from the secondary chamber may be directed to the annular cavity, and a portion of the fluid removable from the annular cavity may be dischargeable to the subsea environment.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
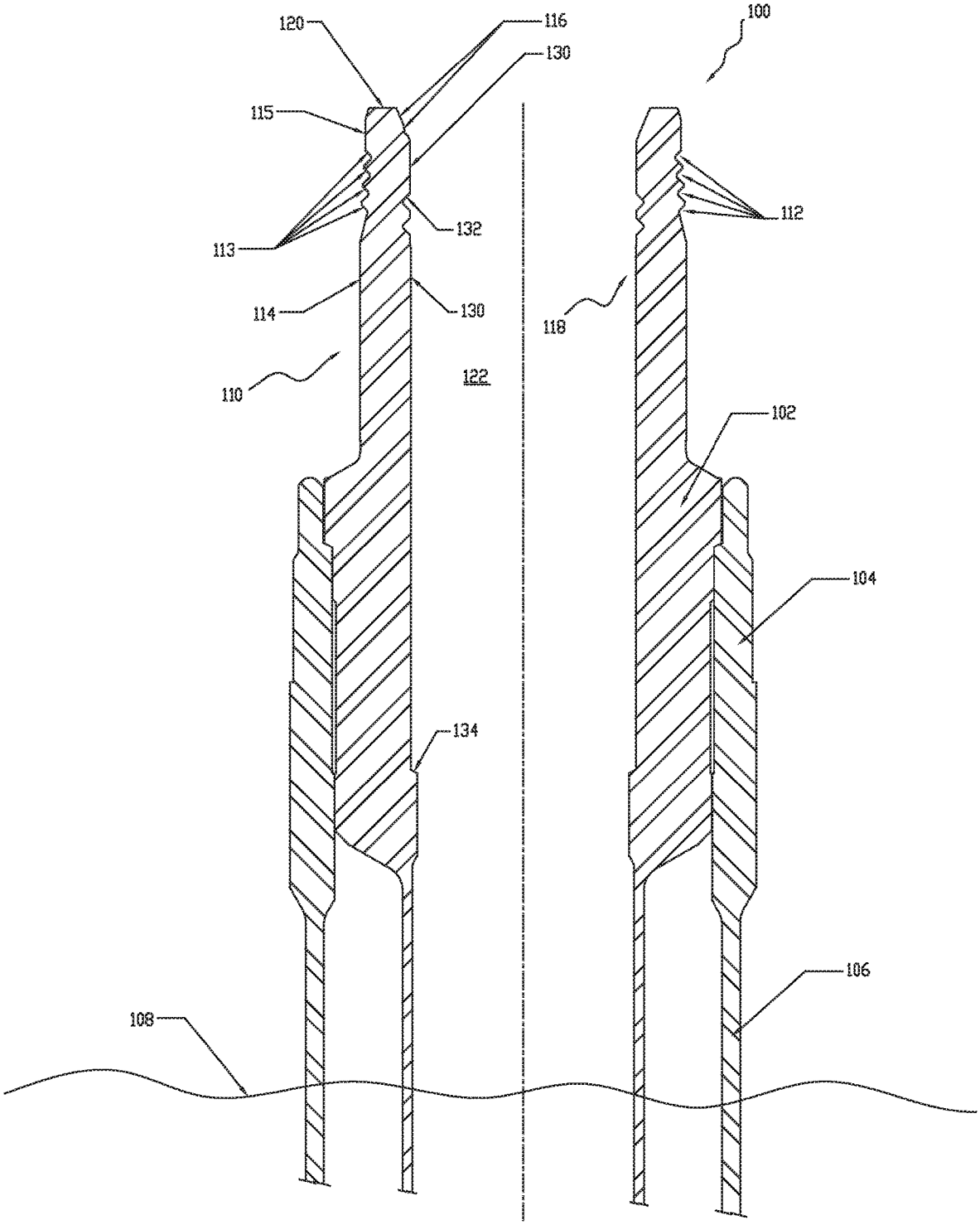
FIG. 1 illustrates a cross sectional view of an example subsea wellhead assembly including a mandrel known to those of ordinary skill in the art.
Figure 2:
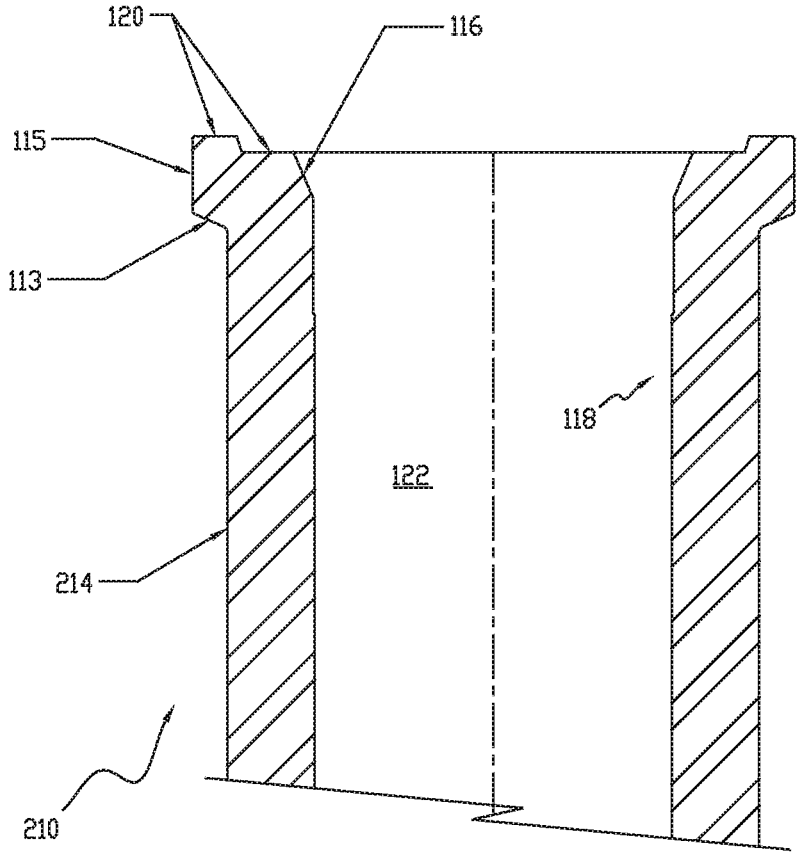
FIG. 2 illustrates a cross sectional view of a hub for a subsea wellhead, subsea tree, or similar subsea equipment, known to those of ordinary skill in the art.
Figure 3:
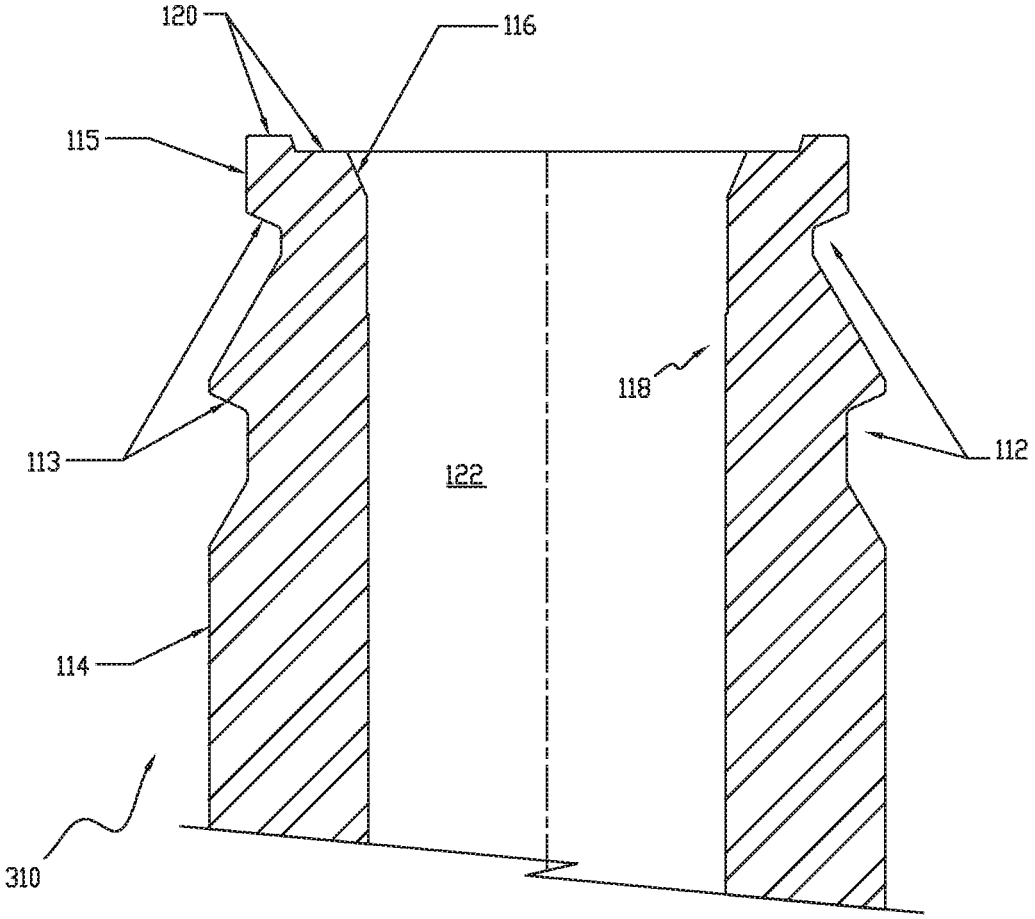
FIG. 3 illustrates a cross sectional view of a dual hub for a subsea wellhead, subsea tree, or similar subsea equipment, known to those of ordinary skill in the art.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Unless otherwise specified, use of the terms "up," "upper," "upward," "above," "top," or other like terms shall be construed as generally toward the surface of the formation or the surface of a body of water as the associated component is arranged therein; likewise, use of "down," "lower," "downward," "below," "bottom," or other like terms shall be construed as generally away from the surface of the formation or the surface of a body of water as the associated component is arranged therein, regardless of the wellbore orientation.

Unless otherwise specified, use of the terms "inner," "inward," "inboard," "interior," "internal," or other like terms shall be construed as generally towards a vertical central axis such as a wellbore central axis; likewise, use of the terms "outer," "outward," "outboard," "exterior," "external," or other like terms shall be construed as generally away from a vertical central axis.

Embodiments of the subsea protective cap assemblies disclosed herein are capable of being coupled to a mandrel or hub of a hydrocarbon well or similar subsea equipment interface. The protective cap assemblies are further configured to maintain a sealing relationship with the mandrel while installed while receiving a corrosion inhibitor fluid therein to prevent corrosion and/or the formation of deposits on the mandrel. To that end, embodiments of the protective cap assemblies of the present disclosure are designed to contain slight internal pressures during and after installation, although the magnitude of pressure is very low (generally about ½ psi to about 100 psi) and is intended primarily to contain corrosion inhibitor fluid injected therein. Since positive pressure containment is necessary to perform the corrosion inhibitor injection procedure, the protective cap assemblies of the present disclosure are designed to carry all or substantially all of the structural loads during the corrosion inhibitor injection procedure, which includes direct internal pressure forces and reactive loads from locking features of the protective cap assembly.

Figure 4:
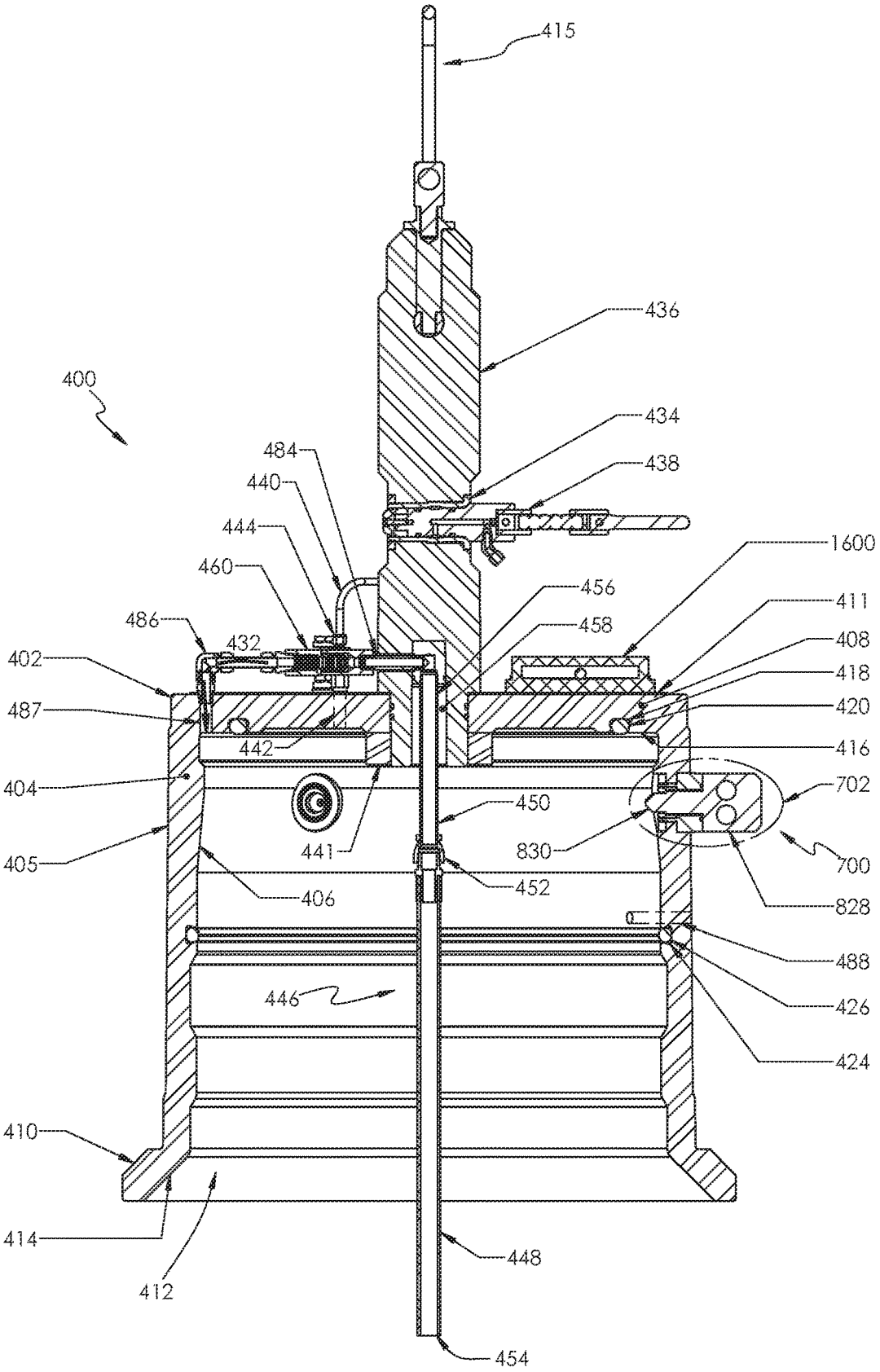
FIG. 4 illustrates a cross sectional view of an example protective cap assembly, according to one or more embodiments of the disclosure.
Figure 5:
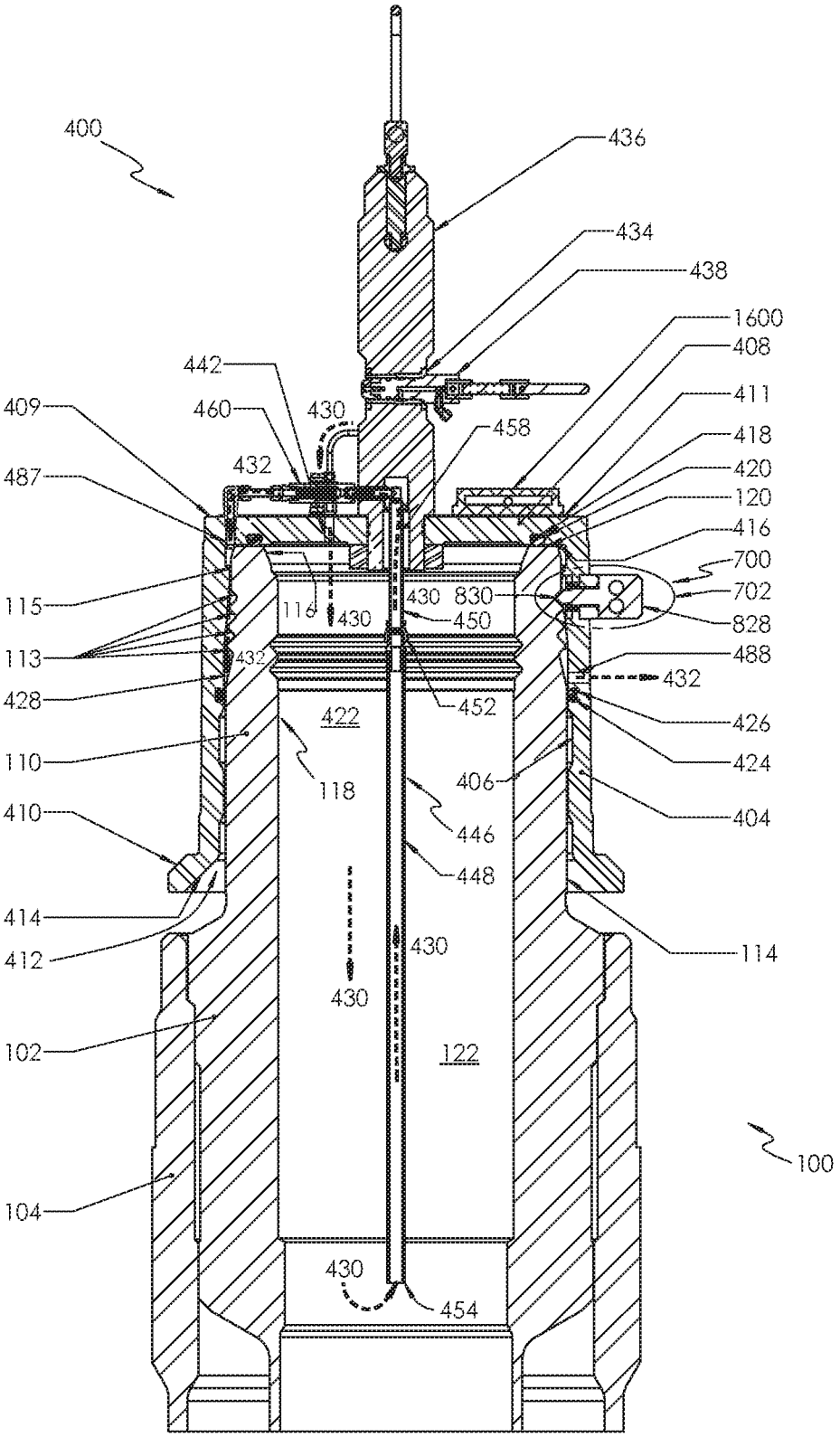
FIG. 5 illustrates a cross sectional view of the protective cap assembly of FIG. 4 disposed on and coupled to a mandrel of an example subsea wellhead assembly, according to one or more embodiments of the disclosure.
Figure 6:
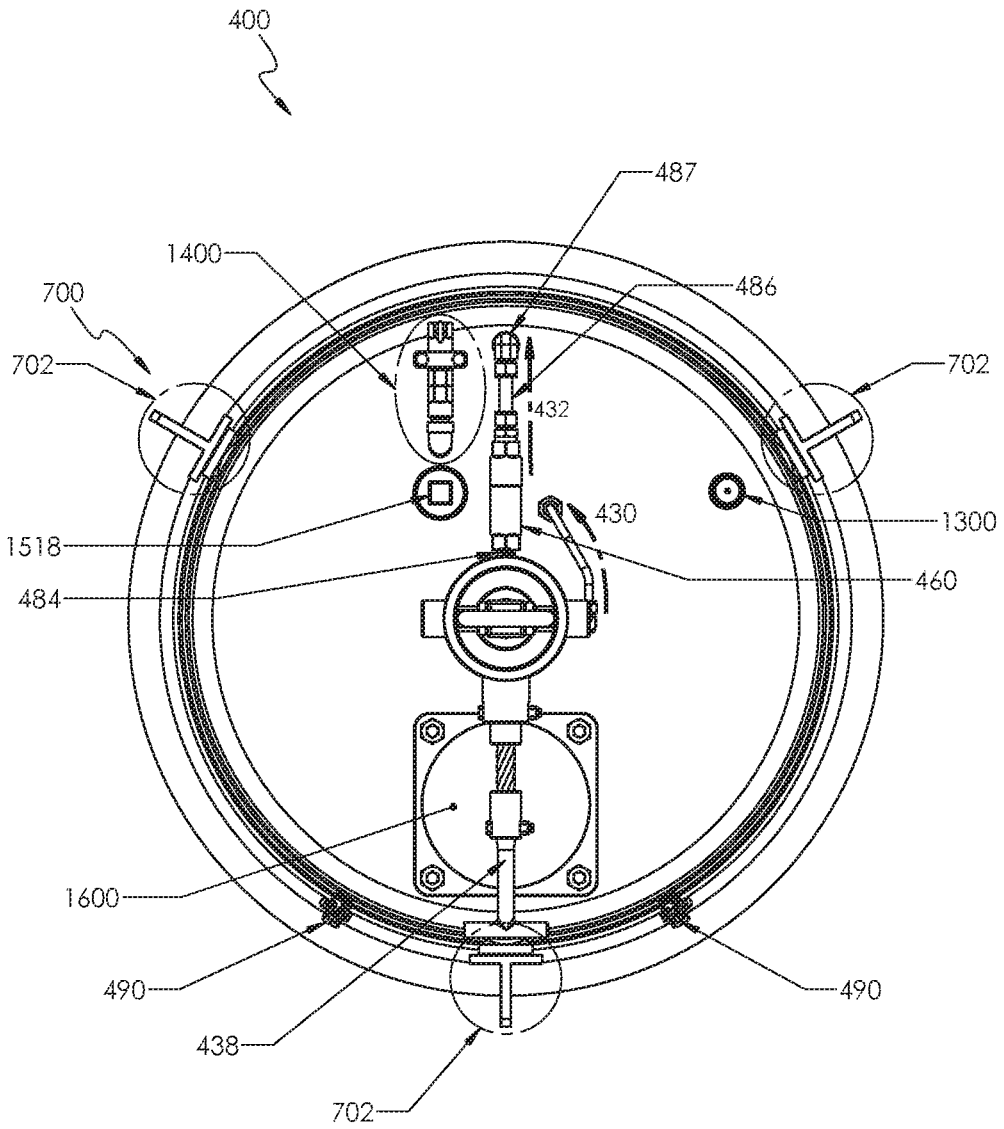
FIG. 6 illustrates a top view of the protective cap assembly of FIG. 4, according to one or more embodiments of the disclosure.
Figure 7:
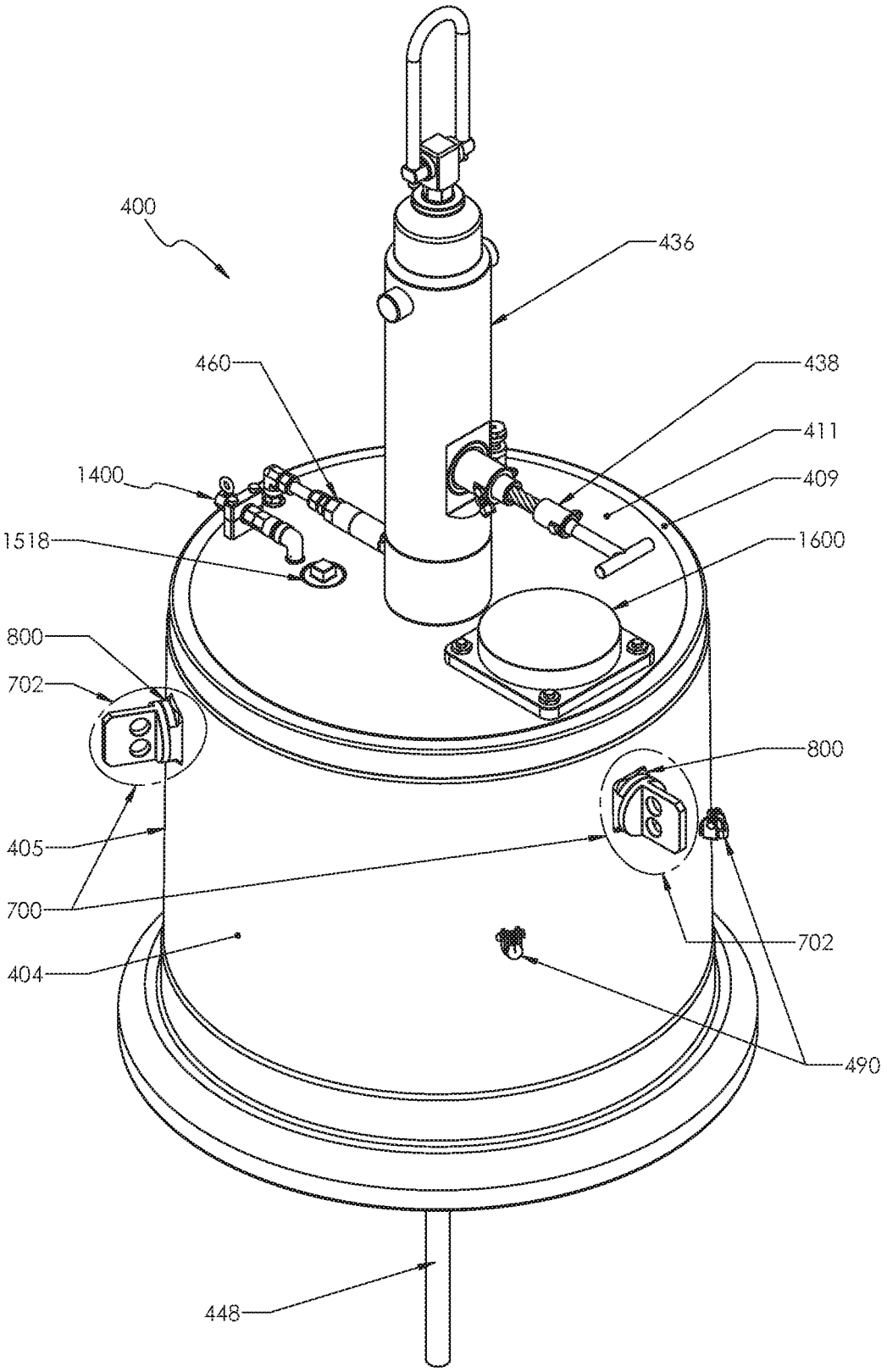
FIG. 7 illustrates an isometric view of the protective cap assembly of FIG. 4 including an example locking system, according to one or more embodiments of the disclosure.

Turning now to the Figures, FIGS. 4-7 illustrate various views of an example protective cap assembly 400, according to one or more embodiments of the disclosure. In particular, FIG. 4 illustrates a cross sectional view of the protective cap assembly 400, according to one or more embodiments of the disclosure. FIG. 5 illustrates a cross sectional view of the protective cap assembly 400 of FIG. 4 disposed on and coupled to an example subsea wellhead assembly, according to one or more embodiments of the disclosure. The example subsea wellhead assembly illustrated in FIG. 5 may be similar in some respects to the subsea wellhead assembly 100 described above and thus may be best understood with reference to FIG. 1, where like numerals designate like components and will not be described again in detail. FIG. 6 illustrates a top view of the protective cap assembly 400 of FIG. 4, according to one or more embodiments of the disclosure. FIG. 7 illustrates an isometric view of the protective cap assembly 400 of FIG. 4, according to one or more embodiments of the disclosure.

The protective cap assembly 400 may be utilized to protect the mandrel of a subsea wellhead, a subsea tubing head spool, or a subsea tree during the temporary abandonment of a subsea hydrocarbon well (not shown). A similar protective cap assembly may be used to protect a subsea tree mandrel for long-term installation. As will be discussed in more detail below, the protective cap assembly 400 may be utilized to protect portions of the mandrel from corrosion and/or deposits forming thereupon. In addition, the protective cap assembly 400 may be utilized to protect portions of the mandrel from contact with external objects and to prevent external objects or debris from entering the bore 122 of the subsea hydrocarbon well.

As shown most clearly in FIG. 5, the protective cap assembly 400 may include a protective cap body 402 configured to be disposed on a mandrel 110 of the subsea wellhead assembly 100. As illustrated, the mandrel 110 may include a plurality of circumferential grooves (four shown 112) formed in an main outer circumferential surface 114 of the mandrel 110 that define one or more angled shoulder surfaces (four shown 113) to provide a connection means to a wellhead connector (not shown). The wellhead connector may interconnect, for example, a blowout preventer (BOP) device (not shown) or production system (not shown) with the mandrel 110. The mandrel 110 may also include one of more conical sealing surfaces 116 extending from an inner circumferential surface 118 to a top face 120 of the mandrel 110. The conical sealing surface 116 may be configured to interface with a metal ring gasket (not shown) of the wellhead connector to seal liquids and gases at varying pressures. The inner circumferential surface 118 of the mandrel may further define a bore 122 through which fluids may enter and exit the wellbore.

The protective cap body 402 may include a cylindrical sidewall 404 having an inner cylindrical surface 406 configured to be disposed about the upper outer circumferential surface 115, the circumferential grooves 112, and the main outer circumferential surface 114 of the mandrel 110, with the inner cylindrical surface 406 having varying inner diameters and tapered surfaces to receive the varying exterior features of the mandrel 110. To that end, an upper end portion of the cylindrical sidewall 404 may be coupled to or integral with a top plate 408 of the protective cap body 402, the top plate 408 being capable of containing low pressures (e.g., about ½ psi to about 100 psi), and a lower end portion of the cylindrical sidewall 404 may be coupled to or integral with a conically shaped wall 410 of the protective cap body 402. The conically shaped wall 410 may define an opening 412 through which the mandrel may be received, and the conically shaped wall may further form a funnel 414 extending from the opening 412 to the inner cylindrical surface 406 to assist with the alignment of the protective cap assembly 400 on the mandrel 110.

The cylindrical sidewall 404, the top plate 408, and the conically shaped wall 410 of the protective cap body 402 may be fabricated individually and assembled together, or may be manufactured as a single unit. In one or more embodiments, one or more of the cylindrical sidewall 404, the top plate 408, and the conically shaped wall 410 may be constructed of a metallic material. In other embodiments, one or more of the cylindrical sidewall 404, the top plate 408, and the conically shaped wall 410 may be constructed of a nonmetallic material. Accordingly, the protective cap assembly 400 may be constructed of a metallic material, a nonmetallic material, or a combination of both. For example, in one or more embodiments, the protective cap body 402 may be constructed of a plastic material as a single molded part.

In embodiments in which one or more of the cylindrical sidewall 404, the top plate 408, and the conically shaped wall 410 may be constructed of a plastic material, the plastic material utilized may include, but is not limited to, polyethylene, polypropylene, acetal, polyurethane, nylon, combinations thereof, or modified variants compounded with fibers such as fiberglass or carbon fiber. In embodiments in which one or more of the cylindrical sidewall 404, the top plate 408, and the conically shaped wall 410 may be constructed of a nonmetallic material other than conventional plastics, the nonmetallic material utilized may include, but is not limited to, fiber-reinforced elastomeric composite materials, fiber-reinforced plastic composite materials, or combinations thereof. In embodiments in which one or more of the cylindrical sidewall 404, the top plate 408, and the conically shaped wall 410 may be constructed of a metallic material, the metallic material utilized may include, but is not limited to, steel, stainless steel, aluminum, titanium, copper alloys, nickel alloys, or combinations thereof.

As shown in FIGS. 4 and 5, an inner surface 416 of the top plate 408 may define an annular groove 418 configured to seat therein a primary seal 420 of the protective cap assembly 400. The primary seal 420 may be disposed in the annular groove 418 such that the primary seal 420 engages the top face 120 of the mandrel 110 in a sealing relationship therewith when disposed thereon. In another embodiment, the primary seal 420 may be coupled to the inner surface 416 of the body 402 with bonded adhesives or alternatively with a plurality of mechanical fasteners (e.g. screws or bolts). In another embodiment, the primary seal 420 may be disposed in the annular groove 418 such that the primary seal 420 engages the conical sealing surface 116 of the mandrel 110 in a sealing relationship therewith. In another embodiment, the inner circumferential surface 406 of the cylindrical sidewall 404 may define an annular groove 418, with the primary seal 420 disposed in the annular groove 418 to contact the upper outer circumferential surface 115 at an upper portion of the mandrel 110.

The primary seal 420 may be constructed of an elastomeric material. For example, the primary seal 420 may be an O-ring. In other embodiments, the primary seal 420 may be a lip seal or a u-cup seal. Those of ordinary skill in the art will appreciate that other seal types may be utilized as the primary seal 420 without departing from the scope of this disclosure. As arranged in FIG. 5, the primary seal 420, the top plate 408, the top face 120, and the inner circumferential surface 118 of the mandrel 110 form at least in part a primary chamber 422 within the bore 122 of the mandrel 110 and inwards of the primary seal 420. As configured, the conical sealing surface 116 and inner cylindrical surface 118 may be isolated from the corrosive seawater and other damaging elements of the subsea environment.

As shown in FIGS. 4 and 5, the inner cylindrical surface 406 of the cylindrical sidewall 404 may define an annular groove 424 configured to seat therein a secondary seal 426 of the protective cap assembly 400. The secondary seal 426 may be disposed in the annular groove 424 such that the secondary seal 426 engages the main outer circumferential surface 114 of the mandrel 110 in a sealing relationship therewith below the plurality of circumferential grooves 112 of the mandrel 110. Similar to the primary seal 420, the secondary seal 426 may be constructed of an elastomeric material. For example, the secondary seal 426 may be an O-ring. In other embodiments, the secondary seal 426 may be a lip seal or a u-cup seal. Those of ordinary skill in the art will appreciate that other seal types may be utilized as the secondary seal 426 without departing from the scope of this disclosure. The primary seal 420 and the secondary seal 426 define respective upper and lower ends of a secondary chamber 428 formed at least in part between the main outer circumferential surface 114 of the mandrel 110 and the inner cylindrical surface 406 of the cylindrical sidewall 404. As configured, the circumferential grooves 112 of the mandrel 110 may be isolated from the corrosive seawater and other damaging elements of the subsea environment.

The protective cap assembly 400 may include a corrosion inhibitor fluid injection assembly fluidly coupled with the primary chamber 422 via a primary fluid flowpath (indicated by dashed line 430) and configured to provide a corrosion inhibitor fluid in contact with the conical sealing surface 116 and inner cylindrical surface 118 of the mandrel 110 to prevent or substantially reduce corrosion thereof. In one or more embodiments, the corrosion inhibitor fluid injection assembly may be fluidly coupled with the secondary chamber 428 via the primary fluid flowpath 430 and a secondary fluid flowpath (indicated by dashed line 432). Accordingly, the corrosion inhibitor fluid injection assembly may be further configured to provide a corrosion inhibitor fluid in contact with the circumferential grooves 112 of the mandrel 110 to prevent or substantially reduce corrosion thereof.

In one or more embodiments, the corrosion inhibitor fluid injection assembly may include a hot stab receptacle 434 mounted to a central post 436 of the protective cap assembly 400, the top post 436 being coupled to and extending upward from the top plate 408 of the protective cap body 402. The hot stab receptacle 434 may be configured to receive a male hot stab 438 connected via hoses and fittings (not shown) to one or more pumps (not shown) controlled by a remotely operated vehicle (ROV) (not shown). The ROV may include a storage tank or other source of corrosion inhibitor fluid. In other embodiments, the ROV may be fluidly coupled to a source of corrosion inhibitor fluid.

The hot stab receptacle 434 may be fluidly coupled with the primary chamber 422 via the primary fluid flowpath 430 defined in part by a conduit 440, a primary inlet port 442 defined by and extending through the top plate 408, and a check valve 444 fluidly coupled to the conduit 440 and the primary inlet port 442. The check valve 444 may be a one-way check valve configured to selectively permit the injection of the corrosion inhibitor fluid into the primary chamber 422 and prevent backflow. A lightweight corrosion inhibitor fluid may be injected via the hot stab receptacle 434 and primary fluid flowpath 430 into the primary chamber 422 within the bore 122 of the mandrel 110, thereby displacing any seawater in the bore downwards, with excess fluid being vented from the primary chamber 422 via a remainder of the primary fluid flowpath 430 defined by a vent pipe assembly 446 of the protective cap assembly 400.

In one or more embodiments, the vent pipe assembly 446 may include a vent pipe extension 448 coupled to a main vent pipe 450. The vent pipe extension 448 may be constructed similarly to the main vent pipe 450, or may differ, for example, in material. Further, it will be appreciated that the vent pipe extension 448 may be constructed in the form of a hose, tubing, or other like conduit. The vent pipe extension 448 may be coupled to the main vent pipe 450 via a pipe fitting 452, as shown in FIGS. 4 and 5. As configured in FIG. 5, the excess fluid displaced downward in the bore 122 to a bottom opening 454 of the vent pipe extension 448 may be vented from the primary chamber 422 via the vent pipe assembly 446 of the protective cap assembly 400. In one or more embodiments, the bottom opening 454 of the vent pipe extension 448 may be disposed between about 6 inches to about 72 inches below the top face 120 of the mandrel 110; however, the length of the vent pipe assembly 446 and thus the column of corrosion inhibitor fluid in the bore 122 may be modified as desired by changing the length of the vent pipe assembly 446.

As shown most clearly in FIGS. 4 and 5, the upper portion 456 of the main vent pipe 450 of the vent pipe assembly 446 may be disposed in a cavity 458 formed in the top post 436 and may be coupled to a check valve 460 via a conduit 484, and further connected to a secondary fluid flowpath 432 and a secondary chamber 428 via another conduit 486. In another embodiment, the upper portion 456 of the main vent pipe 450 may be connected to a port (not shown) in the top plate 408 of the protective cap body. Those of ordinary skill in the art will appreciate that there are many ways to configure a fluid port to pass fluid through a protective cap body without departing from the scope of the present disclosure. In another embodiment, the upper portion 456 of the main vent pipe 450 of the vent pipe assembly 446 may be disposed in the cavity 458 formed in the top post 436 and may be fluidly coupled directly to the subsea environment via the conduit 484 and the check valve 460. In one or more embodiments, the check valve 460 may be a one-way check valve with a low opening pressure (e.g., about ½ psi to about 25 psi) to create a barrier between the primary chamber 422 and the external subsea environment. Those of ordinary skill in the art will appreciate that the opening pressure of the check valve 460 may be low, as any backpressure under the top plate 408 during the injection of the corrosion inhibitor injection fluid may lead to very high and undesirable lifting forces. In another embodiment, the check valve 460 may be disposed within the primary chamber 422 and coupled to either of the main vent pipe 450 or the vent pipe extension 448.

Figure 8:
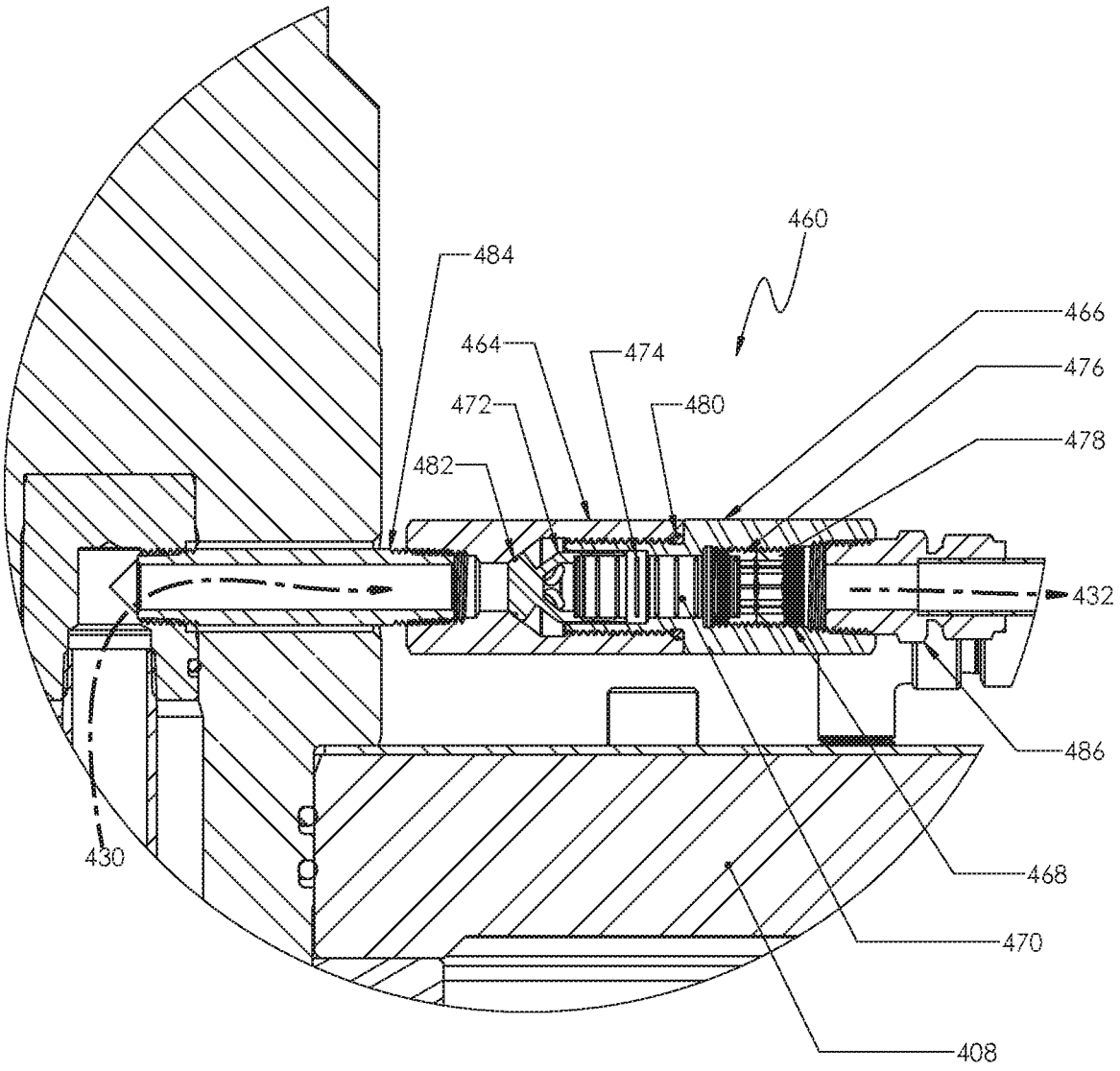
FIG. 8 illustrates an enlarged cross sectional view of an example check valve for a protective cap assembly, according to one or more embodiments of the disclosure.

Turning now to FIG. 8 with continued reference to FIGS. 4-7, FIG. 8 illustrates an enlarged cross sectional view of an example check valve 460 with an internal adjustment feature, according to one or more embodiments. The check valve 460 may include a valve body 464 coupled to a valve closure 466 having threads 468, the valve body 464 and the valve closure 466 as coupled defining a valve chamber 470. The check valve 460 may further include a piston 472 and a spring 474 disposed within the valve chamber 470. The check valve 460 may also have a valve body seal 480 (e.g., an O-ring) and a piston seal 482 (e.g., an O-ring). In one embodiment, the check valve may include a threaded adjusting component 476 and a threaded locking component 478 within the valve chamber 470 to allow adjustment and calibration of the valve opening pressure. In one or more embodiments, each of the threaded adjusting component 476 and the threaded locking component 478 may be a threaded collar or nut. The threaded adjusting component 476 and the threaded locking component 478 may be threadingly coupled to the valve closure 466 within the valve chamber 470 via the internal threads 468. In another embodiment, the threaded adjusting component 476 and the threaded locking component 478 may be threadingly coupled to the valve body 464 within the valve chamber 470 via internal threads (not shown) defined by the valve body 464.

In an embodiment for an externally adjustable check valve (not shown), the threaded adjusting component 476 may pass through the valve body 464, while being threadingly coupled to the valve body 464, with the threaded locking component 478 external to the chamber 470, thereby providing valve adjustment and locking functions external to the valve chamber 470. In another embodiment for an externally adjustable check valve, the threaded adjusting component 476 may pass through the valve closure 466, while being threadingly coupled to the valve closure 466, with the threaded locking component 478 external to the chamber 470. For both externally adjustable check valves, the position of the threaded adjusting component 476 may be varied externally to the valve chamber 470 to increase or decrease the amount of pressure applicable to the piston 472 and the spring 474 within the valve chamber 470 to open the check valve 460. The position of the threaded locking component 478 external to the valve chamber 470 may be varied accordingly to prevent the threaded adjusting component 476 from moving once the desired position of the threaded adjusting component 476 is determined.

As shown in FIGS. 4-7, the secondary fluid flowpath 432 may be defined, in part, by another conduit 486 extending from the check valve 460 to a secondary inlet port 487 defined by and extending through the top plate 408 of the protective cap body 402 and fluidly coupling the secondary chamber 428 and the primary chamber 422. Following the secondary fluid flowpath 432, the fluid vented from the primary chamber 422 via the vent pipe assembly 446 and the conduit 484 may flow through the check valve 460, the conduit 486, and the secondary inlet port 487, and into the secondary chamber 428. In another embodiment, an ROV-operated valve (not shown) may be disposed in the secondary fluid flowpath 432 between the check valve 460 and the secondary inlet port 487, such that the ROV-operated valve may direct fluid from the check valve 460 to the secondary inlet port 487, or alternatively may direct fluid directly to the subsea environment, depending on the valve position as set by the ROV. As configured in the present disclosure, the secondary inlet port 487 provides the injection point for the corrosion inhibitor fluid to enter the secondary chamber 428. As shown in FIGS. 4 and 5, the cylindrical sidewall 404 may define one or more secondary outlet ports (one shown 488) at the lower end of the secondary chamber 428, where the secondary outlet ports 488 may serve as the remainder of the secondary fluid flowpath 432 to allow excess fluid to be vented from the secondary chamber 428 to the external subsea environment. The secondary outlet ports 488 may include one or more check valves (two shown 490) as shown in FIGS. 6 and 7 to selectively prevent the corrosion inhibitor fluid from exiting the secondary chamber 428. In another embodiment, the secondary outlet ports 488 may include a screen fitting (not shown). In another embodiment as shown in FIGS. 4 and 5, the secondary outlet ports 488 may be unobstructed.

With reference to FIGS. 4-7, the protective cap assembly 400 may have an active locking system 700 configured to engage and disengage with the mandrel 110 of the subsea wellhead assembly 100 via an ROV. The locking system 700 may be further configured to couple the protective cap body 402 with and maintain a sealing relationship with the mandrel 110 to allow a corrosion inhibitor fluid to be injected into the protective cap assembly 400 to prevent corrosion and/or the formation of deposits on the mandrel. As shown in FIGS. 4 and 5, the locking assembly 702 may further include an actuator 828 integral with or operatively coupled to a locking pin 830 and configured to selectively engage and disengage the locking pin 830 from the angled shoulder surface 113 of the mandrel. As shown most clearly in FIGS. 6 and 7, the locking system 700 may include a plurality of locking assemblies 702 disposed circumferentially about the protective cap body 402 and circumferentially spaced from one another.

Figure 18:
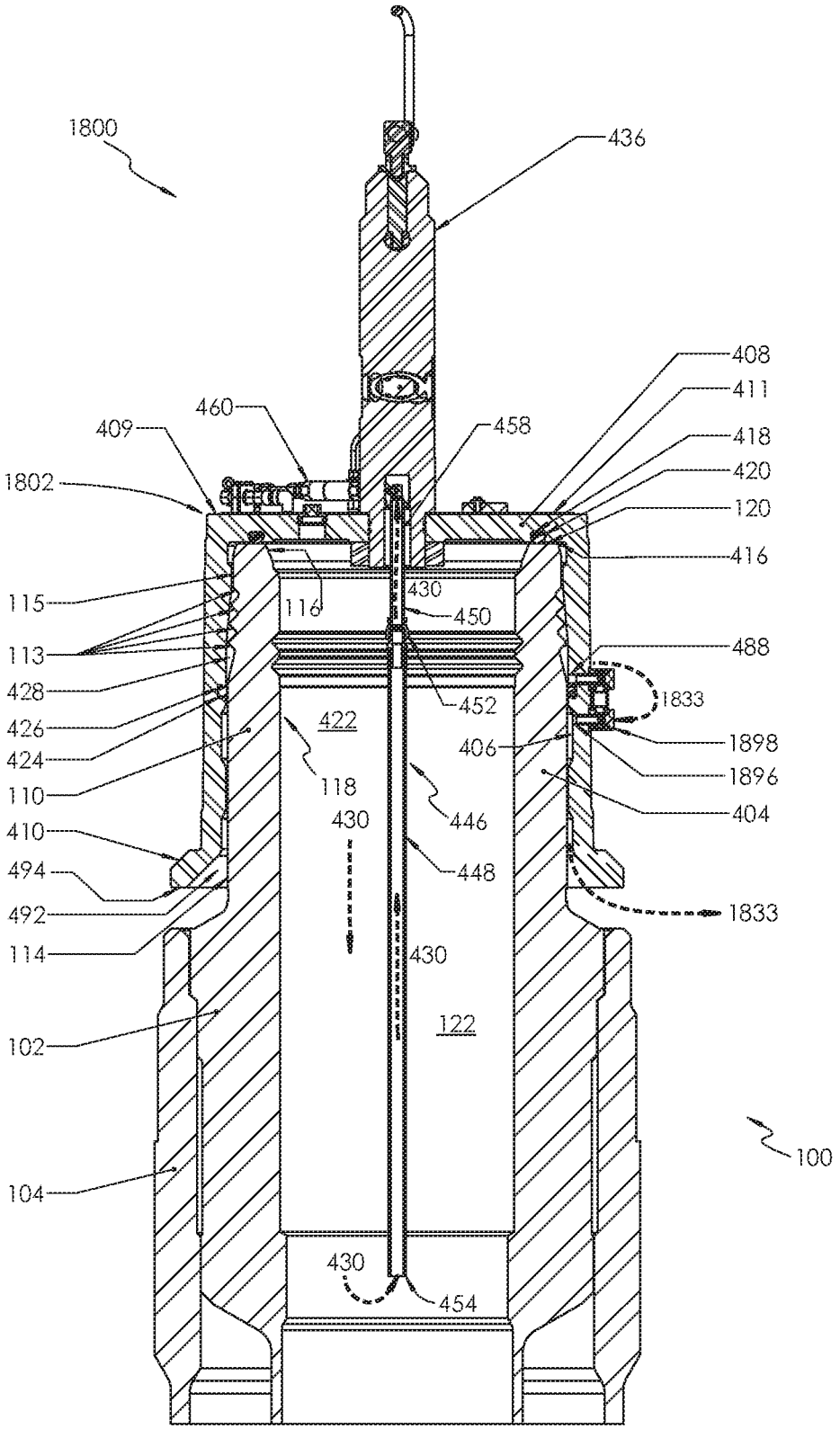
FIG. 18 illustrates a cross sectional view of another example protective cap assembly disposed on and coupled to a subsea wellhead mandrel, according to one or more embodiments of the disclosure.

Referring now to FIG. 18 with continued reference to FIGS. 4-7, FIG. 18 illustrates a cross sectional view of a protective cap assembly 1800 disposed on and coupled to an example subsea wellhead assembly 100, according to one or more embodiments of the disclosure. The protective cap assembly 1800 may be similar in some respects to the protective cap assembly 400 described above and thus may be best understood with reference to FIGS. 4-7 and the description thereof, where like numerals designate like components and will not be described again in detail.

As illustrated in FIG. 18, the protective cap assembly 1800 may include a protective cap body 1802 configured to be disposed on a mandrel 110 of the subsea wellhead assembly 100. The protective cap body 1802 may include a cylindrical sidewall 404 having an inner cylindrical surface 406 configured to be disposed about the upper outer circumferential surface 115, the circumferential grooves 112, and the main outer circumferential surface 114 of the mandrel 110.

As shown in FIG. 18, an inner surface 416 of the top plate 408 may define an annular groove 418 configured to seat therein a primary seal 420 of the protective cap assembly 400. The primary seal 420 may be disposed in the annular groove 418 such that the primary seal 420 engages the top face 120 of the mandrel 110 in a sealing relationship therewith when disposed thereon. In another embodiment, the primary seal 420 may be coupled to the inner surface 416 of the protective cap body 1802 with bonded adhesives or alternatively with a plurality of mechanical fasteners (e.g. screws or bolts). In another embodiment, the inner circumferential surface 406 of the cylindrical sidewall 404 may define an annular groove 418, with the primary seal 420 disposed in the annular groove 418 to contact the upper outer circumferential surface 115 at an upper portion of the mandrel 110. In each of the embodiments, the primary seal 420, the top plate 408, the top face 120, and the inner circumferential surface 118 of the mandrel 100 form at least in part a primary chamber 422 inwards of the primary seal 420.

As shown in FIG. 18, the cylindrical sidewall 404 may further define another annular groove 424 configured to seat therein a secondary seal 426 of the protective cap assembly 1800. The secondary seal 426 may be disposed in the annular groove 424 such that the secondary seal 426 engages the main outer circumferential surface 114 of the mandrel 110 in a sealing relationship therewith below the plurality of circumferential grooves 112. The primary seal 420 and the secondary seal 426 define respective upper and lower ends of a secondary chamber 428 formed at least in part between the main outer circumferential surface 114 of the mandrel 110 and the inner cylindrical surface 406 of the cylindrical sidewall 404. The primary chamber 422 and the secondary chamber 428 may be fluidly coupled with one another via a primary fluid flowpath (indicated by dashed line 430) and a secondary fluid flowpath (indicated by dashed line 432) with a check valve 460 to selectively prevent fluid from exiting the primary chamber 422. The secondary fluid flowpath 432 may be further defined by a secondary inlet port 487 in the protective cap body 1802 that provides an injection point for fluid to enter the secondary chamber 428.

As shown in FIG. 18, an annular cavity 492 may be formed in part by the main outer circumferential surface 114, the secondary seal 426, and the inner circumferential surface 406. The annular cavity may be open to the subsea environment at a bottom portion thereof. A bottom face 494 of the protective cap body 1802 in FIG. 18 may define a lower boundary of the bottom portion of the annular cavity 492, with the secondary seal 426 defining the upper boundary of a top portion of the annular cavity 492. The secondary chamber 428 and the annular cavity 492 may be fluidly coupled with one another via a tertiary fluid flowpath (indicated by dashed line 1833). The tertiary fluid flowpath 1833 may be defined in part by one or more secondary outlet ports (one shown 488) in the cylindrical sidewall 404 near the bottom of the secondary chamber 428 and above the secondary seal 426. The tertiary fluid flowpath 1833 may be further defined by one or more tertiary inlet ports (one shown 1896) in the cylindrical sidewall 404 that provide an injection point for fluid to enter the annular cavity 492 below the secondary seal 426. As shown in FIG. 18, the annular cavity 492 which is open at a bottom portion thereof to the subsea environment may serve as the remainder of the tertiary fluid flowpath 1833 to allow excess fluid to be vented to the external subsea environment.

The one or more secondary outlet ports 488 of the protective cap body 1802 may be fluidly coupled to the one or more tertiary inlet ports 1896 by one of more conduits (one shown 1898). As shown in FIG. 18, the fluid exiting the secondary chamber 428 may be directed via the tertiary fluid flowpath 1833 through the conduit 1898 to the tertiary inlet port 1896 that is fluidly coupled to the annular cavity 492, with any excess fluid directed from the annular cavity 492 at the bottom portion thereof to the external subsea environment.

With reference to FIG. 18, the primary seal 420 and the secondary seal 426 may each be constructed of an elastomeric material. For example, the primary seal 420 and/or the secondary seal 426 may be an O-ring. In other embodiments, the primary seal 420 and/or the secondary seal 426 may be a lip seal or a u-cup seal. Those of ordinary skill in the art will appreciate that other seal types may be utilized as the primary seal 420 and/or the secondary seal 426 without departing from the scope of this disclosure.

The protective cap assembly 1800 of FIG. 18 may have an active locking system 700 including one or more locking assemblies 702 configured to engage and disengage with the mandrel 110 of the subsea wellhead assembly 100 via an ROV. Each locking assembly 702 may be further configured to couple the protective cap body 1802 with and maintain a sealing relationship with the mandrel 110 to allow a corrosion inhibitor fluid to be injected into the protective cap assembly 1800 to prevent corrosion and/or the formation of deposits on the mandrel 110. As shown in FIG. 18, the locking assembly 702 may include an actuator 828 integral with or operatively coupled to a locking pin 830 and configured to selectively engage and disengage the locking pin 830 from the angled shoulder surface 113 of the mandrel 110.

Figure 9:
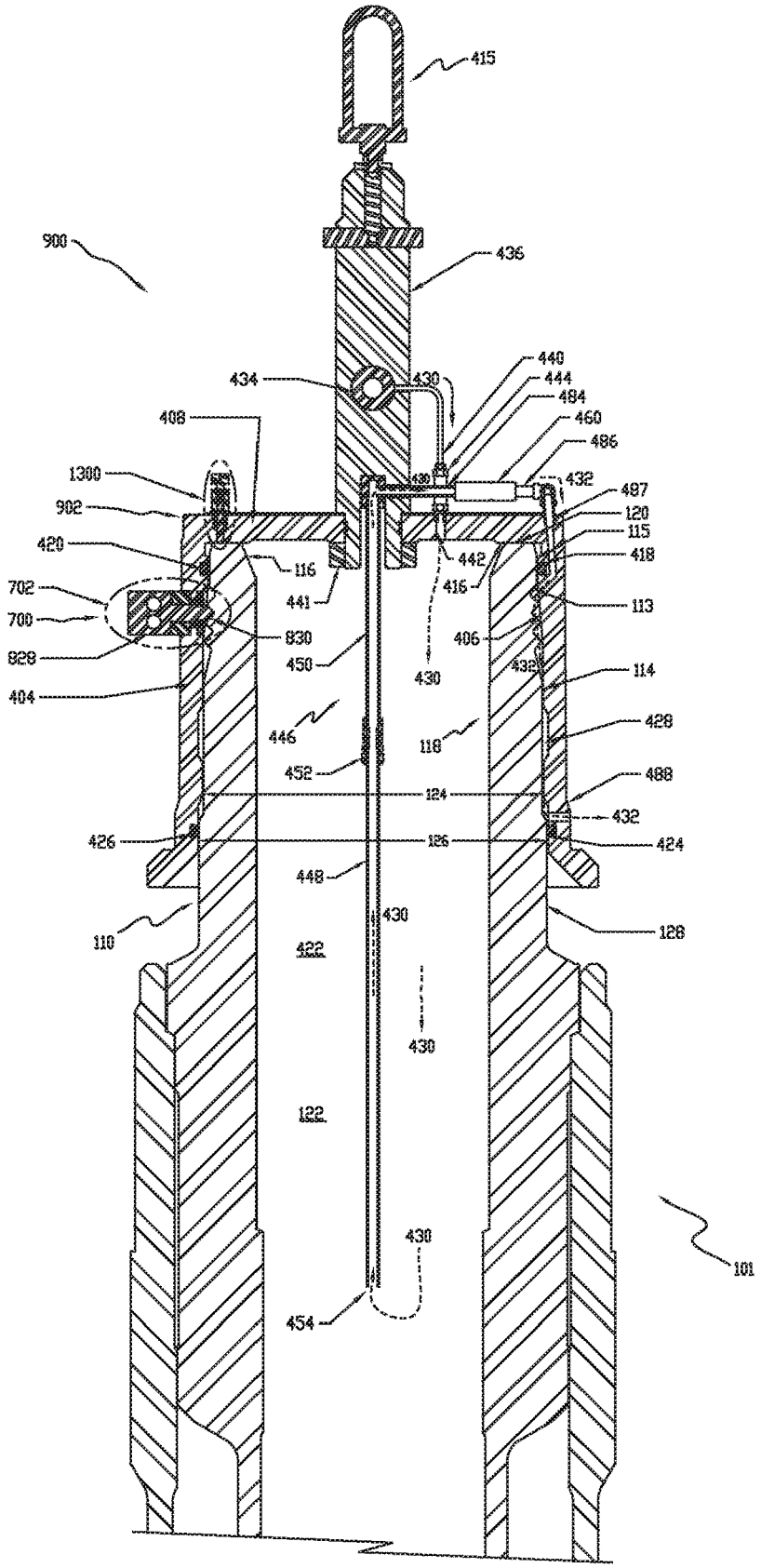
FIG. 9 illustrates a cross sectional view of another example protective cap assembly disposed on and coupled to a subsea wellhead mandrel, according to one or more embodiments of the disclosure.

Referring now to FIG. 9, FIG. 9 illustrates a cross sectional view of another example protective cap assembly 900 disposed on and coupled to a subsea wellhead assembly 101, according to one or more embodiments of the disclosure. The protective cap assembly 900 may be similar in some respects to the protective cap assembly 400 described above and thus may be best understood with reference to FIGS. 4-7 and the description thereof, where like numerals designate like components and will not be described again in detail. Additionally, the subsea well head assembly 101 may be similar in some respects to subsea wellhead assembly 100 described above and thus like numerals may reflect like components.

As illustrated in FIG. 9, the protective cap assembly 900 may include a protective cap body 902 configured to be disposed on a mandrel 110 of the subsea wellhead assembly 101. The protective cap body 902 may include a cylindrical sidewall 404 having an inner cylindrical surface 406 configured to be disposed about the upper outer circumferential surface 115, the circumferential grooves 112, and the main outer circumferential surface 114 of the mandrel 110. The cylindrical sidewall 404 may define an annular groove 418 configured to seat therein a primary seal 420 of the protective cap assembly 900. The primary seal 420 may be disposed in the annular groove 418 such that the primary seal 420 engages the upper outer circumferential surface 115 at the top of the mandrel 110 in a sealing relationship therewith above the plurality of circumferential grooves 112 of the mandrel 110.

In another embodiment, the primary seal 420 may be disposed in the annular groove 418 such that the primary seal 420 engages the main outer circumferential surface 114 of the mandrel 110 in a sealing relationship therewith below the plurality of circumferential grooves 112 of the mandrel 110. Below the plurality of circumferential grooves 112, the main outer circumferential surface 114 of the mandrel 110 may be stepped, such that the outer circumferential surface of the mandrel 110 may have a first diameter 124, and a second diameter 126 corresponding to the stepped outer circumferential surface 128 and arranged below the first diameter. Accordingly, in an embodiment in which the primary seal 420 engages an outer circumferential surface of the mandrel 110 in a sealing relationship therewith below the plurality of circumferential grooves 112, the primary seal 420 may be disposed in the annular groove 418 such that the primary seal 420 sealingly engages the main outer circumferential surface 114 of the mandrel 110 having the first diameter 124, or the stepped outer circumferential surface 128 of the mandrel 110 having the second diameter 126. In all embodiments noted, the primary seal 420, the top plate 408, the top face 120, and the inner circumferential surface 118 of the mandrel 110 form at least in part a primary chamber 422 within the bore 122 of the mandrel 110 and inwards of the primary seal 420.

As shown in FIG. 9, the cylindrical sidewall 404 may further define another annular groove 424 configured to seat therein a secondary seal 426 of the protective cap assembly 900. The secondary seal 426 may be disposed in the annular groove 424 such that the secondary seal 426 engages the main outer circumferential surface 114 or the stepped outer circumferential surface 128 of the mandrel 110 in a sealing relationship therewith below the plurality of circumferential grooves 112. The primary seal 420 and the secondary seal 426 define respective upper and lower ends of a secondary chamber 428 formed at least in part between the main outer circumferential surface 114 of the mandrel 110 and the inner cylindrical surface 406 of the cylindrical sidewall 404. The primary chamber 422 and the secondary chamber 428 may be fluidly coupled with one another via a primary fluid flowpath (indicated by dashed line 430) and a secondary fluid flowpath (indicated by dashed line 432) with a check valve 460 to selectively prevent fluid from exiting the primary chamber 422. The secondary fluid flowpath 432 may be further defined by a secondary inlet port 487 in the protective cap body 902 that provides an injection point for fluid to enter the secondary chamber 428. The cylindrical sidewall 404 may further define one or more secondary outlet ports (one shown 488) for the secondary chamber 428 at the bottom of the secondary chamber 428 and above the secondary seal 426, thereby fluidly coupling the secondary fluid flowpath 432 with the external subsea environment to vent excess fluid to the subsea environment. The secondary outlet port(s) 488 may include a check valve (not shown). In another embodiment, the secondary outlet port(s) 488 may include a screen fitting (not shown). In the embodiment as shown in FIG. 9, the secondary outlet port(s) 488 may be unobstructed.

With reference to FIG. 9, the primary seal 420 and the secondary seal 426 may each be constructed of an elastomeric material. For example, the primary seal 420 and/or the secondary seal 426 may be an O-ring. In other embodiments, the primary seal 420 and/or the secondary seal 426 may be a lip seal or a u-cup seal. Those of ordinary skill in the art will appreciate that other seal types may be utilized as the primary seal 420 and/or the secondary seal 426 without departing from the scope of this disclosure.

The protective cap assembly 900 of FIG. 9 may have an active locking system 700 including one or more locking assemblies 702 configured to engage and disengage with the mandrel 110 of the subsea wellhead assembly 101 via an ROV. Each locking assembly 702 may be further configured to couple the protective cap body 902 with and maintain a sealing relationship with the mandrel 110 to allow a corrosion inhibitor fluid to be injected into the protective cap assembly 900 to prevent corrosion and/or the formation of deposits on the mandrel 110. As shown in FIG. 9, the locking assembly 702 may include an actuator 828 integral with or operatively coupled to a locking pin 830 and configured to selectively engage and disengage the locking pin 830 from the angled shoulder surface 113 of the mandrel 110.

Figure 10:
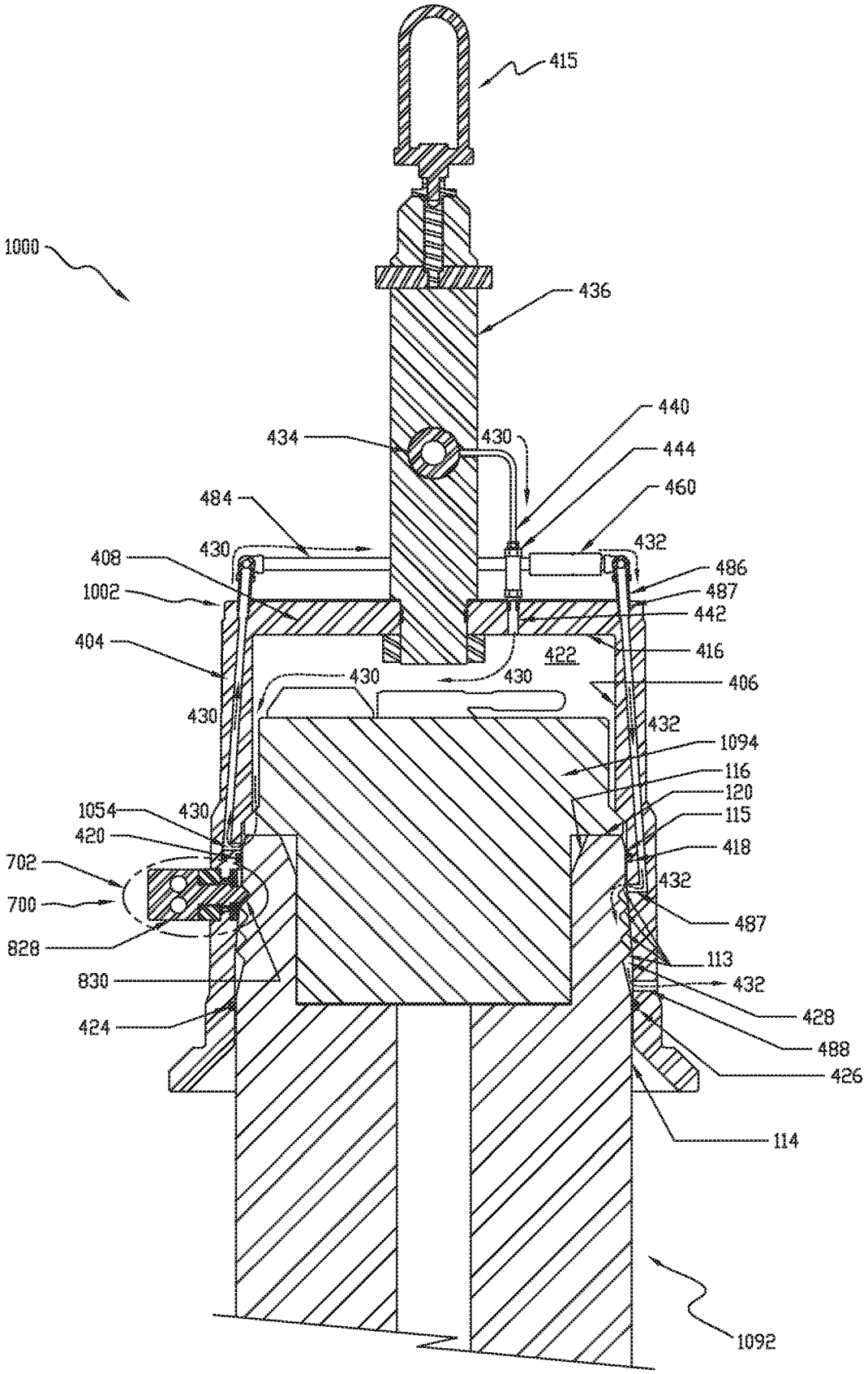
FIG. 10 illustrates a cross sectional view of another example protective cap assembly disposed on and coupled to a subsea tree mandrel, according to one or more embodiments of the disclosure.

Referring now to FIG. 10, FIG. 10 illustrates a cross sectional view of another example protective cap assembly 1000 disposed on and coupled to a subsea tree mandrel 1092, according to one or more embodiments of the disclosure. The protective cap assembly 1000 may be similar in some respects to the protective cap assembly 400 described above and thus may be best understood with reference to FIGS. 4-7 and the description thereof, where like numerals designate like components and will not be described again in detail. As shown in FIG. 10, the subsea tree may include a subsea tree mandrel 1092 with an internal tree cap 1094 coupled to the subsea tree mandrel 1092, such that the internal tree cap 1094 protrudes above the top face 120 of the subsea tree mandrel 1092. The protective cap assembly 1000 may be configured to be disposed over the internal tree cap 1094 and coupled to the subsea tree mandrel 1092.

As illustrated in FIG. 10, the protective cap assembly 1000 may include a protective cap body 1002 configured to be disposed on a subsea tree including a subsea tree mandrel 1092 and an internal tree cap 1094. The protective cap body 1002 may include a cylindrical sidewall 404 having an inner cylindrical surface 406 configured to be disposed about the upper outer circumferential surface 115, the circumferential grooves 112, and the main outer circumferential surface 114 of the subsea tree mandrel 1092. The cylindrical sidewall 404 may define an annular groove 418 configured to seat therein a primary seal 420 of the protective cap assembly 1000. The primary seal 420 may be disposed in the annular groove 418 such that the primary seal 420 engages the upper outer circumferential surface 115 of the subsea tree mandrel 1092 in a sealing relationship therewith above the plurality of circumferential grooves 112 of the subsea tree mandrel 1092. The primary seal 420, the top plate 408, the cylindrical sidewall 404, and the subsea tree mandrel 1092 form at least in part a primary chamber 422 located predominantly above the subsea tree mandrel 1092 and inwards of the primary seal 420. As configured, the conical sealing surface 116 may be isolated from the corrosive seawater and other damaging elements of the subsea environment.

The cylindrical sidewall 404 may further define another annular groove 424 configured to seat therein a secondary seal 426 of the protective cap assembly 1000. The secondary seal 426 may be disposed in the annular groove 424 such that the secondary seal 426 engages the main outer circumferential surface 114 of the subsea tree mandrel 1092 in a sealing relationship therewith below the plurality of circumferential grooves 112. The primary seal 420 and the secondary seal 426 define respective upper and lower ends of a secondary chamber 428 formed at least in part by the main outer circumferential surface 114 of the subsea tree mandrel 1092 and the inner circumferential surface 406 of the cylindrical sidewall 404. As configured, the circumferential grooves 112 of the subsea tree mandrel 1092 may be isolated from the seawater and other damaging elements of the subsea environment.

With reference to FIG. 10, the primary seal 420 and the secondary seal 426 may each be constructed of an elastomeric material. For example, the primary seal 420 and/or the secondary seal 426 may be an O-ring. In other embodiments, the primary seal 420 and/or the secondary seal 426 may be a lip seal or a u-cup seal. Those of ordinary skill in the art will appreciate that other seal types may be utilized as the primary seal 420 and/or the secondary seal 426 without departing from the scope of this disclosure.

The primary chamber 422 and the secondary chamber 428 of FIG. 10 may be fluidly coupled with one another via a primary fluid flowpath (indicated by dashed line 430) and a secondary fluid flowpath (indicated by dashed line 432). Similar to the embodiment illustrated in FIGS. 4-7, the corrosion inhibitor fluid may be injected into the primary chamber 422 via the primary fluid flowpath 430 formed in part by the primary inlet port 442 defined by and extending through the upper portion of the protective cap body 1002. The primary fluid flowpath 420 is further defined by one or more primary outlet ports 1054 defined by the cylindrical sidewall 404 and fluidly coupled to the check valve 460 via the conduit 484. The primary outlet port 1054 may be positioned above and proximal the primary seal 420 at the lower end portion of the primary chamber 422. The check valve 460 may fluidly couple the primary and secondary fluid flowpaths 430 and 432, such that the check valve 460 is fluidly coupled to a secondary inlet port 487 for the secondary chamber 428 via another conduit 486. The secondary inlet port 487 may be defined by the cylindrical sidewall 404 and located below the primary seal 420. The cylindrical sidewall 404 may further define one or more secondary outlet ports (one shown 488) for the secondary chamber 428 at the bottom of the secondary chamber 428 and above the secondary seal 426, thereby fluidly coupling the secondary fluid flowpath 432 with the external subsea environment to vent excess fluid to the subsea environment. The secondary outlet port(s) 488 may include a check valve (not shown). In another embodiment, the secondary outlet port(s) 488 may include a screen fitting (not shown). In the embodiment as shown in FIG. 10, the secondary outlet port(s) 488 may be unobstructed.

In an embodiment directed to a heavy corrosion inhibitor fluid for a subsea tree application, although not shown, those of ordinary skill in the art will understand that the primary inlet port 442 for the primary chamber 422 may be disposed at the bottom of the primary chamber 422, and the primary outlet port 454 may be disposed at the top of the primary chamber 422, and the secondary inlet port 487 for the secondary chamber 428 may be disposed at the bottom of the secondary chamber 428, and the secondary outlet port 488 may be disposed at the top of the secondary chamber 428.

The protective cap assembly 1000 of FIG. 10 may have an active locking system 700 including one or more locking assemblies 702 configured to engage and disengage with a mandrel 110 of a subsea tree via an ROV. Each locking assembly 702 may be further configured to couple the protective cap body 402 with and maintain a sealing relationship with the mandrel 110 to allow a corrosion inhibitor fluid to be injected into the protective cap assembly 400 to prevent corrosion and/or the formation of deposits on the mandrel. As shown in FIG. 10, the locking assembly 702 may further include an actuator 828 integral with or operatively coupled to a locking pin 830 and configured to selectively engage and disengage the locking pin 830 from the angled shoulder surface 113 of the subsea tree mandrel 1092.

Figure 11:
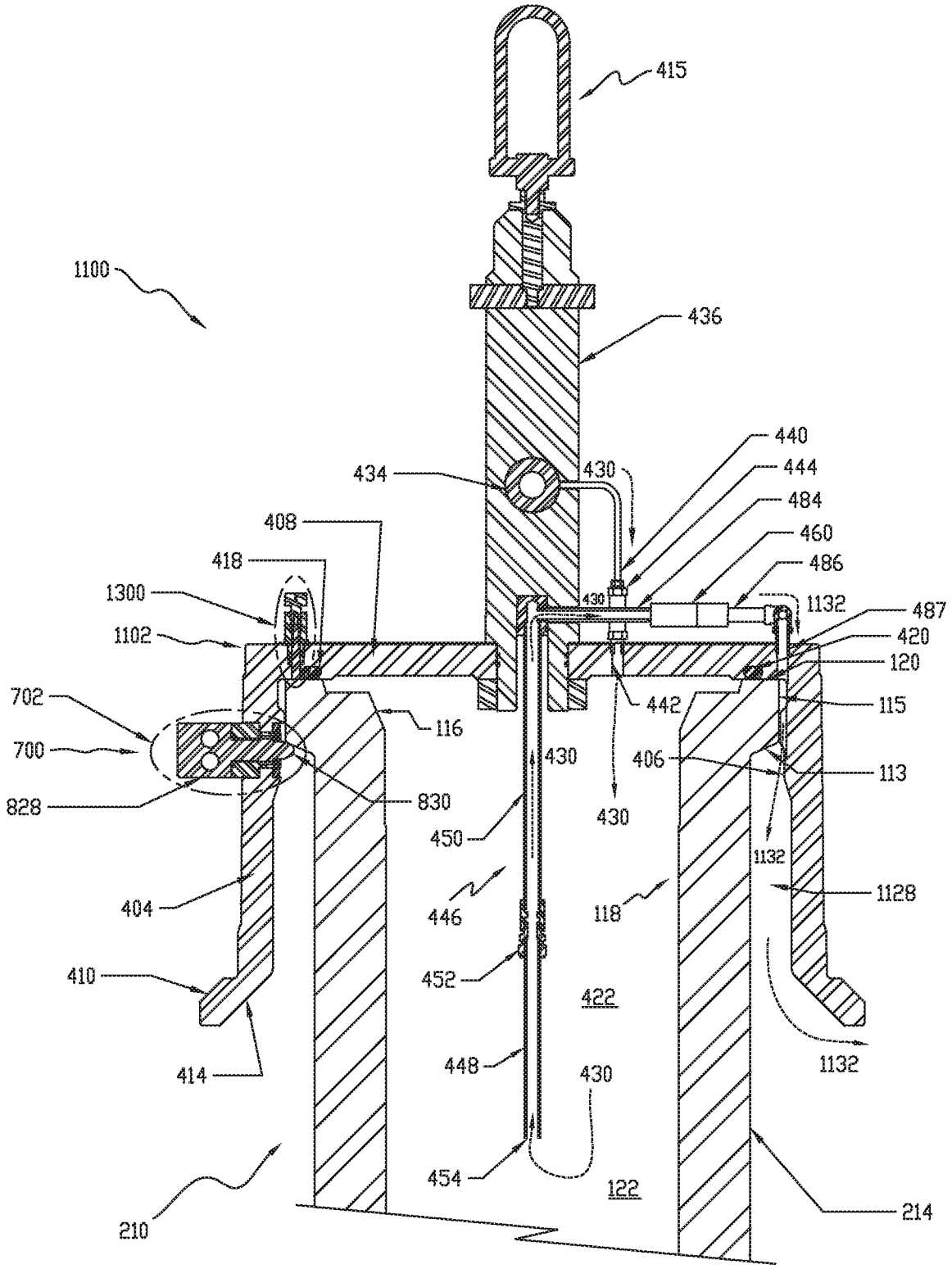
FIG. 11 illustrates a cross sectional view of another example protective cap assembly disposed on and coupled to a subsea equipment hub, according to one or more embodiments of the disclosure.

Referring now to FIG. 11, FIG. 11 illustrates a cross sectional view of another example protective cap assembly 1100 disposed on and coupled to a subsea equipment hub 210, according to one or more embodiments of the disclosure. The protective cap assembly 1100 may be similar in some respects to the protective cap assembly 400 described above and thus may be best understood with reference to FIGS. 4-7 and the description thereof, where like numerals designate like components and will not be described again in detail.

As illustrated in FIG. 11, the protective cap assembly 1100 may include a protective cap body 1102 configured to be disposed on the hub 210. The protective cap body 1102 may include a cylindrical sidewall 404 having an inner cylindrical surface 406 configured to be disposed about the upper outer circumferential surface 115 of the hub 210. Further, the upper end portion of the cylindrical sidewall 404 may be coupled to or integral with a top plate 408 of the protective cap body 1102. An inner surface 416 of the top plate 408 may define an annular groove 418 configured to seat therein a primary seal 420 of the protective cap assembly 1100. The primary seal 420 may be disposed in the annular groove 418 such that the primary seal 420 engages a top face 120 of the hub 210 in a sealing relationship therewith when disposed thereon. In another embodiment, the primary seal 420 may be disposed in an annular groove 418 to contact the upper outer circumferential surface 115 at the top of the hub 210. In both embodiments, the primary seal 420, the top plate 408, the top face 120, and the inner circumferential surface 118 of the hub 210 form at least in part a primary chamber 422 within the bore 122 of the hub 210 and inwards of the primary seal 420.

The large upper outer circumferential surface 115 of the hub 210 may create a significant annular gap between the inner circumferential surface 406 of the protective cap body 1102 and the smaller main outer circumferential surface 214. An annular cavity 1128 may be formed in part by the main outer circumferential surface 214, the angled shoulder surface 113, the inner circumferential surface 406, and open to the subsea environment at the bottom. As shown in FIG. 11, the fluid exiting the primary chamber 422 via a primary fluid flowpath 430 to a conduit 484 and a check valve 460 may be directed via a secondary fluid flowpath 1132 through a conduit 486 to a secondary inlet port 487 that is fluidly coupled to the annular cavity 1128, with any excess fluid directed from the annular cavity 1128 at the bottom to the external subsea environment. In another embodiment, the fluid exiting the primary chamber 422 via the primary fluid flowpath 430 may be directed via the check valve 460 directly to the subsea environment.

With reference to FIG. 11, the primary seal 420 may each be constructed of an elastomeric material. For example, the primary seal 420 may be an O-ring. In other embodiments, the primary seal 420 may be a lip seal or a u-cup seal. Those of ordinary skill in the art will appreciate that other seal types may be utilized as the primary seal 420 without departing from the scope of this disclosure.

The protective cap assembly 1100 of FIG. 11 may have an active locking system 700 including one or more locking assemblies 702 configured to engage and disengage with a hub 210 of a subsea wellhead assembly, a subsea tubing head spool, a subsea tree, or similar subsea equipment via an ROV. Each locking assembly 702 may be further configured to couple the protective cap body 402 with and maintain a sealing relationship with the hub 210 to allow a corrosion inhibitor fluid to be injected into the protective cap assembly 400 to prevent corrosion and/or the formation of deposits on the hub. As shown in FIG. 11, the locking assembly 702 may further include an actuator 828 integral with or operatively coupled to a locking pin 830 and configured to selectively engage and disengage the locking pin 830 from the angled shoulder surface 113 of the hub.

Figure 12:
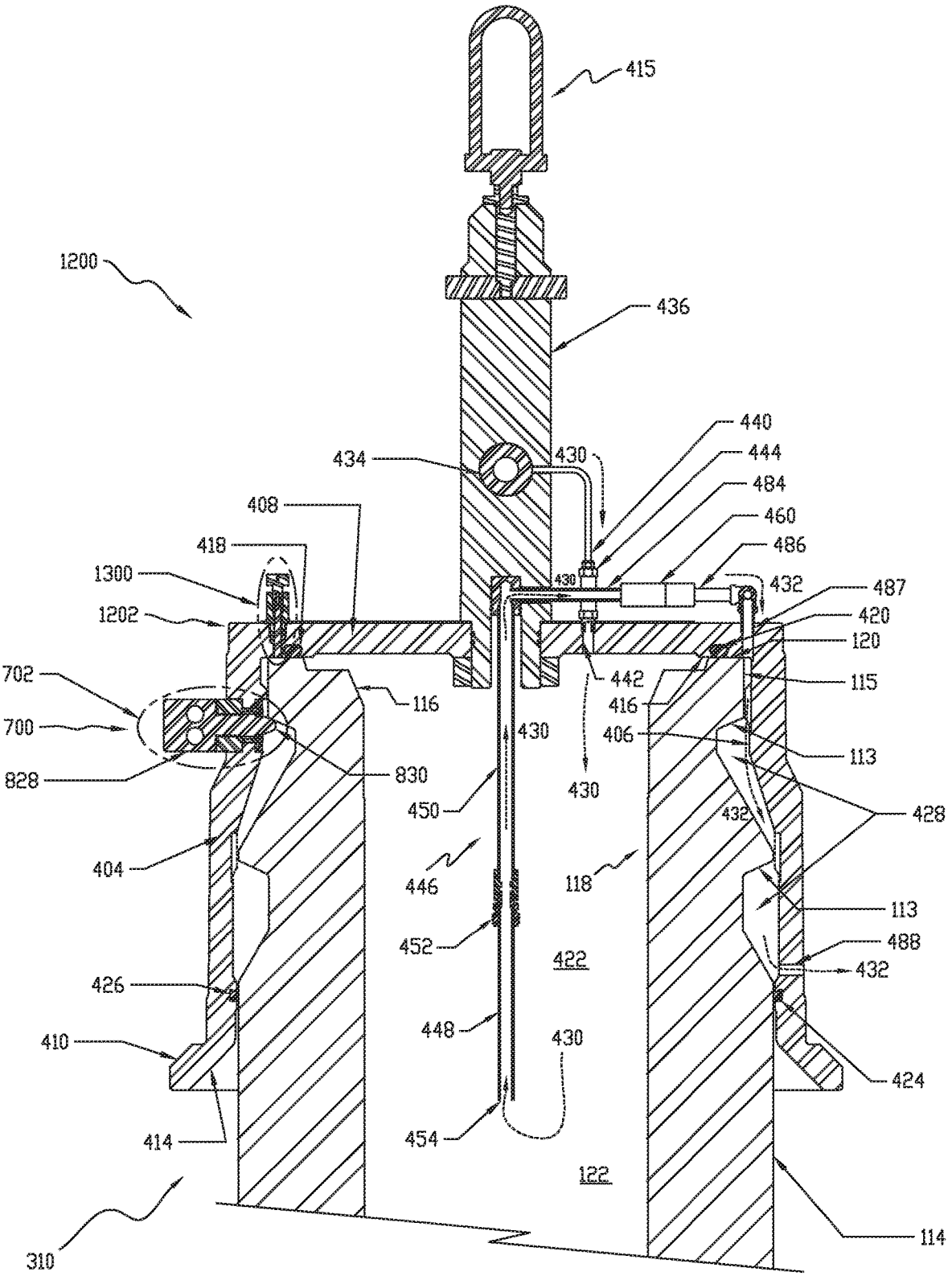
FIG. 12 illustrates a cross sectional view of another example protective cap assembly disposed on and coupled to a dual hub for a subsea wellhead or subsea tree, according to one or more embodiments of the disclosure.

Referring now to FIG. 12, FIG. 12 illustrates a cross sectional view of another example protective cap assembly 1200 disposed on and coupled to the dual hub 310, according to one or more embodiments of the disclosure. The protective cap assembly 1200 may be similar in some respects to the protective cap assembly 400 described above and thus may be best understood with reference to FIGS. 4-7 and the description thereof, where like numerals designate like components and will not be described again in detail.

As illustrated in FIG. 12, the protective cap assembly 1200 may include a protective cap body 1202 configured to be disposed on a dual hub 310. The protective cap body 1202 may include a cylindrical sidewall 404 having an inner cylindrical surface 406 configured to be disposed about the upper outer circumferential surface 115, the circumferential grooves 112, and the main outer circumferential surface 114 of the dual hub 310. Further, the upper end portion of the cylindrical sidewall 404 may be coupled to or integral with a top plate 408 of the protective cap body 1202. An inner surface 416 of the top plate 408 may define an annular groove 418 configured to seat therein a primary seal 420 of the protective cap assembly 1200. The primary seal 420 may be disposed in the annular groove 418 such that the primary seal 420 engages a top face 120 of the dual hub 310 in a sealing relationship therewith when disposed thereon. In another embodiment, the primary seal 420 may be disposed in an annular groove 418 defined by the inner cylindrical surface 406 to contact the upper outer circumferential surface 115 at the top of the dual hub 310. In both embodiments, the primary seal 420, the top plate 408, the top face 120, and the inner circumferential surface 118 of the dual hub 310 form at least in part a primary chamber 422 inwards of the primary seal 420.

As shown in FIG. 12, the cylindrical sidewall 404 may further define another annular groove 424 configured to seat therein a secondary seal 426 of the protective cap assembly 1200. The secondary seal 426 may be disposed in the annular groove 424 such that the secondary seal 426 engages the main outer circumferential surface 114 of the dual hub 310 in a sealing relationship therewith below the plurality of circumferential grooves 112. The primary seal 420 and the secondary seal 426 define respective upper and lower ends of a secondary chamber 428 formed at least in part between the main outer circumferential surface 114 of the dual hub 310 and the inner cylindrical surface 406 of the cylindrical sidewall 404. The primary chamber 422 and the secondary chamber 428 may be fluidly coupled with one another via a primary fluid flowpath (indicated by dashed line 430) and a secondary fluid flowpath (indicated by dashed line 432) with a check valve 460 to selectively prevent fluid from exiting the primary chamber 422. The secondary fluid flowpath 432 may be further defined by a secondary inlet port 487 in the protective cap body 902 that provides an injection point for fluid to enter the secondary chamber 428. The cylindrical sidewall 404 may further define one or more secondary outlet ports (one shown 488) for the secondary chamber 428 at the bottom of the secondary chamber 428 and above the secondary seal 426, thereby fluidly coupling the secondary fluid flowpath 432 with the external subsea environment to vent excess fluid to the subsea environment. The secondary outlet port(s) 488 may include a check valve (not shown). In another embodiment, the secondary outlet port(s) 488 may include a screen fitting (not shown). In the embodiment as shown in FIG. 9, the secondary outlet port(s) 488 may be unobstructed.

With reference to FIG. 12, the primary seal 420 and the secondary seal 426 may each be constructed of an elastomeric material. For example, the primary seal 420 and/or the secondary seal 426 may be an O-ring. In other embodiments, the primary seal 420 and/or the secondary seal 426 may be a lip seal or a u-cup seal. Those of ordinary skill in the art will appreciate that other seal types may be utilized as the primary seal 420 and/or the secondary seal 426 without departing from the scope of this disclosure.

The protective cap assembly 1200 of FIG. 12 may have an active locking system including one or more locking assemblies 702 configured to engage and disengage with a dual hub 310 of a subsea wellhead assembly, a subsea tubing head spool, a subsea tree, or similar subsea equipment via an ROV. Each locking assembly 702 may be further configured to couple the protective cap body 402 with and maintain a sealing relationship with the dual hub 310 to allow a corrosion inhibitor fluid to be injected into the protective cap assembly 400 to prevent corrosion and/or the formation of deposits on the dual hub 310. As shown in FIG. 12, the locking assembly 702 may further include an actuator 828 integral with or operatively coupled to a locking pin 830 and configured to selectively engage and disengage the locking pin 830 from the angled shoulder surface 113 of the dual hub 310.

Figure 13:
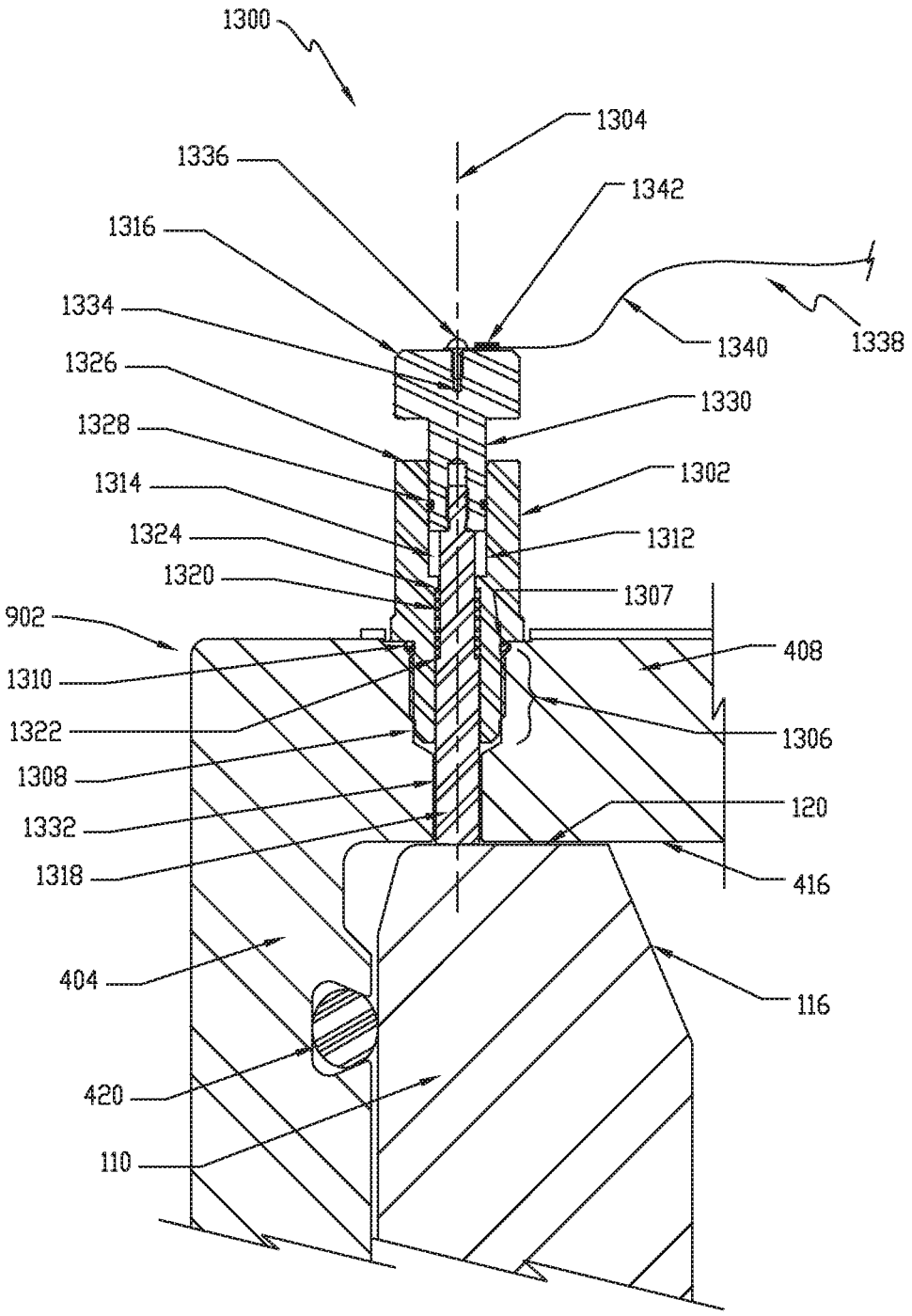
FIG. 13 illustrates an enlarged cross sectional view of an example indicator rod assembly for a protective cap assembly, according to one or more embodiments of the disclosure.

In one or more embodiments, in order to ensure reliability of the locking and sealing of the protective cap assembly with a mandrel or hub, the protective cap assembly 400, 900, 1100, 1200 may be further configured to provide visual feedback when the protective cap assembly 400, 900, 1100, 1200 is in proximal contact with a top face 120 of a mandrel 110, hub 210, or dual hub 310. As shown in FIG. 9, the protective cap assembly 900 may include a sealed, spring-biased indicator rod assembly 1300 configured to provide visual feedback for an ROV when the protective cap body 902 is in proximal contact with the top face 120 of the mandrel 110 during installation of the protective cap assembly 900 on the mandrel 110. FIG. 13 illustrates an enlarged cross sectional view of the indicator rod assembly 1300, according to one or more embodiments of the disclosure. Although most clearly illustrated with reference to the protective cap assembly 900 of FIG. 9, it will be appreciated that the indicator rod assembly 1300 may be included in other example protective cap assemblies disclosed herein. For example, the indicator rod assembly 1300 may be included in the protective cap assembly 400, as illustrated in FIG. 4, the protective cap assembly 1100, as illustrated in FIG. 11, or the protective cap assembly 1200, as illustrated in FIG. 12.

The indicator rod assembly 1300 may include an indicator body 1302 having a longitudinal axis 1304 and a threaded lower end portion 1306 configured to threadingly engage with a threaded port 1308 defined by and extending through the top plate 408 of the protective cap assembly 800. As engaged with the top plate 408, an elastomeric seal 1310 (e.g., an O-ring) may be disposed in an indicator body groove 1311 defined by the threaded lower end portion 1306 and arranged in a sealing relationship with the top plate 408. An inner circumferential surface 1312 of the indicator body 1302 may define an indicator body chamber 1314 in which an upper piston 1316 and a lower piston 1318 may be coupled with one another and travel along the longitudinal axis 1304.

A biasing member 1320, illustrated as a compression spring, may be disposed about the lower piston 1318, seated on a shoulder 1322 thereof and on an axially opposing shoulder 1324 of the indicator body, and arranged to bias the lower piston 1318 downward, such that the upper piston 1316 coupled thereto contacts a top face 1326 of the indicator body 1302 during installation of the protective cap assembly 800 to the mandrel 110. During installation and operation of the protective cap assembly 800, as the lower piston 1318 is brought into contact with the top face 120 of the mandrel 110, the upper piston 1316 is urged upward and away from the top face 1326 of the indicator body 1302, thereby providing visual indication of the protective cap assembly 800 being in proximal contact with the top face 120 of the mandrel 110. To provide sealing, an elastomeric seal 1328 (e.g., an O-ring) may be mounted in a groove formed in an outer circumferential surface 1330 of the upper piston 1316 and engaging the inner circumferential surface 1312 of the indicator body 1302, thereby isolating the primary chamber 422 from the external subsea environment. In another embodiment, the elastomeric seal 1328 may be mounted in a groove formed in an outer circumferential surface 1332 of the lower piston 1318 and contacting the inner circumferential surface 1312 of the indicator body 1302, thereby containing the corrosion inhibitor fluid within the protective cap assembly 800. In one or more embodiments, the upper piston 1316 may further define a threaded hole 1334 configured to accept a mechanical fastener 1336 (e.g., a machine screw) to attach a wire or grounding lead 1338. The grounding lead 1338 may include a conductive wire 1340 and one or more terminal fittings (one shown 1342). The grounding lead 1338 may be utilized to provide a path for electrical continuity from other metallic components external of the protective cap assembly 900 through the protective cap body 902 directly to the mandrel 110.

Figure 14:
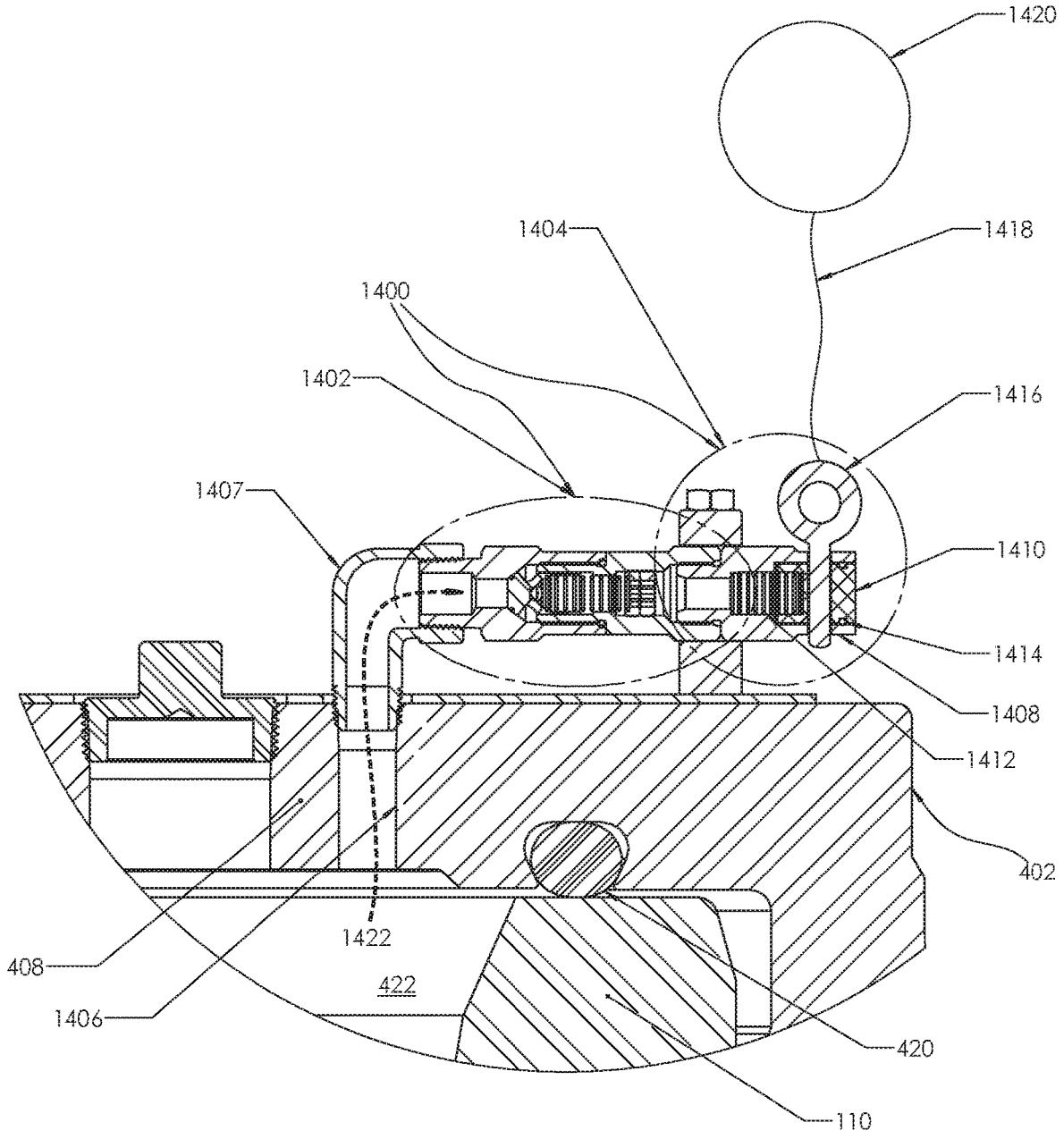
FIG. 14 illustrates an enlarged cross sectional view of an example gas venting valve assembly mounted to a top plate of a protective cap assembly, according to one or more embodiments of the disclosure.

In one or more embodiments, in order to allow natural gas, methane, carbon dioxide and other gases to be released from under from the protective cap assembly 400 while retaining the injected corrosion inhibitor fluid, the protective cap assembly 400 may include a gas venting valve assembly 1400. FIG. 14 illustrates an enlarged cross sectional view of the gas venting valve assembly 1400 mounted to the top plate 408, according to one or more embodiments of the disclosure, to provide a gas venting flowpath 1422 from the primary chamber 422.

The gas venting valve assembly 1400 may include a one-way check valve 1402 fluidly coupled with an ROV actuated valve assembly 1404. In at least one embodiment, a one-way check valve 1402 with adjustment feature may be used to provide a precise valve opening pressure, similar in function to check valve 460. The gas venting valve assembly 1400 may be fluidly coupled with a gas outlet port 1406 defined by the body 402 of the protective cap assembly 400 and configured to provide an outlet for any gas that accumulates in the primary chamber 422. Accordingly, the gas venting valve assembly 1400 may include the check valve 1402 fluidly coupled with the gas outlet port 1406 via a conduit 1407 and configured such that the specified opening pressure for the check valve 1402 is selected to be lower than opening pressure of the check valve 460 disposed in the primary fluid flowpath 430. The ROV actuated valve assembly 1404 may be configured to be closed during the injection of the corrosion inhibitor fluid. After the injection of the corrosion inhibitor fluid is completed, the ROV actuated valve assembly 1404 may be opened or otherwise enabled to allow for venting of any gas accumulating in the primary chamber 422 if the gas pressure exceeds a predetermined opening pressure of the check valve 1402.

As shown in FIG. 14, the ROV actuated valve assembly 1404 may be an ROV-enabled plug-type valve. The ROV-enabled plug-type valve may include a valve body 1408, a piston 1410, a spring 1412, an elastomeric seal 1414 (e.g., O-ring), and a pull pin 1416, connected with to a small float 1420 via a rope 1418. The ROV-enabled plug-type valve will remain closed until the ROV removes the pull pin 1416, at which point any internal pressure will displace the piston 1410 assisted by the spring 1412. In another embodiment, the ROV actuated valve assembly may be an ROV-operated shut-off valve (not shown) with an ROV handle to allow the ROV to close or open the valve.

Figure 15:
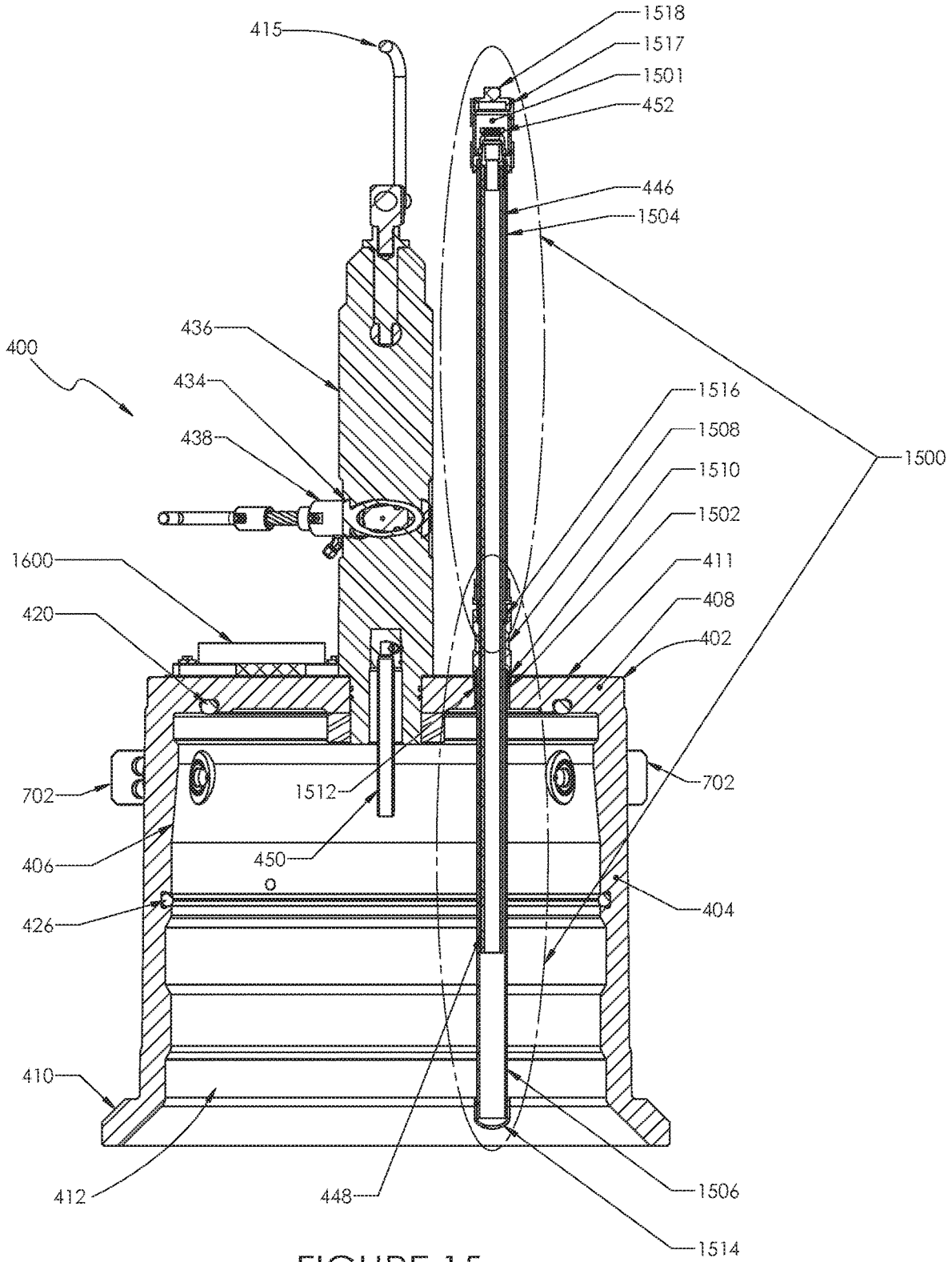
FIG. 15 illustrates a cross section view of an example storage tube assembly coupled to a protective cap body of the protective cap assembly, according to one or more embodiments of the disclosure.

Looking now at FIG. 15 with continued reference to FIGS. 4-7, FIG. 15 illustrates a storage tube assembly 1500 coupled to the protective cap body 402 of the protective cap assembly 400, according to one or more embodiments of the disclosure. As the vent pipe extension 448 may extend from the opening 412 of the protective cap body 402, the vent pipe extension 448 may be susceptible to damage if coupled to the main vent pipe 450 during transport. Accordingly, the storage tube assembly 1500 may be configured to provide a storage tube cavity 1501 for storage and protection of the vent pipe extension 448 during transport of the protective cap assembly 400. During transport, the storage tube assembly 1500 containing the vent pipe extension 448 may be inserted through a threaded port 1502 defined by the top plate 408 of the protective cap body 402. The storage tube assembly 1500 may include an upper tube 1504 and a lower tube 1506 coupled with one another via a central adapter fitting 1508. The central adapter fitting 1508 may have external threads 1510 for attachment to the threaded port 1502 in the top plate 408 and may further define at a lower end a socket 1512 for attaching the lower tube 1506 inserted therein by gluing, bonding or threading. The lower tube 1506 may include a plug or cap 1514 to seal a bottom end portion thereof. The upper end of the central adapter fitting 1508 may define a socket 1516 for attaching the upper tube 1504 inserted therein by gluing, bonding or threading. The upper tube 1504 also may be closed at the top end portion via a threaded plug 1518 or cap. As illustrated in FIG. 15, the upper tube 1504 may have a threaded adapter 1517 at the top end portion thereof for coupling with the threaded plug or cap 1518. After shipment in preparation for installation, the shipping tube assembly 1500 may be decoupled from the top plate 408 via the central adapter fitting 1508, and the vent pipe extension 448 may be removed from the storage tube cavity 1501 defined by the upper tube 1504 and the lower tube 1506. The vent pipe extension 448 may then be attached to the main vent pipe 450. Accordingly, the shipping tube assembly 1500 is thus removed from the protective cap body 402 and may be discarded. A threaded plug may be installed in the threaded port 1502 in the top plate 408 to seal the primary chamber 422 from the external subsea environment, utilizing threaded plug 1518 in one or more embodiments.

Figure 16:
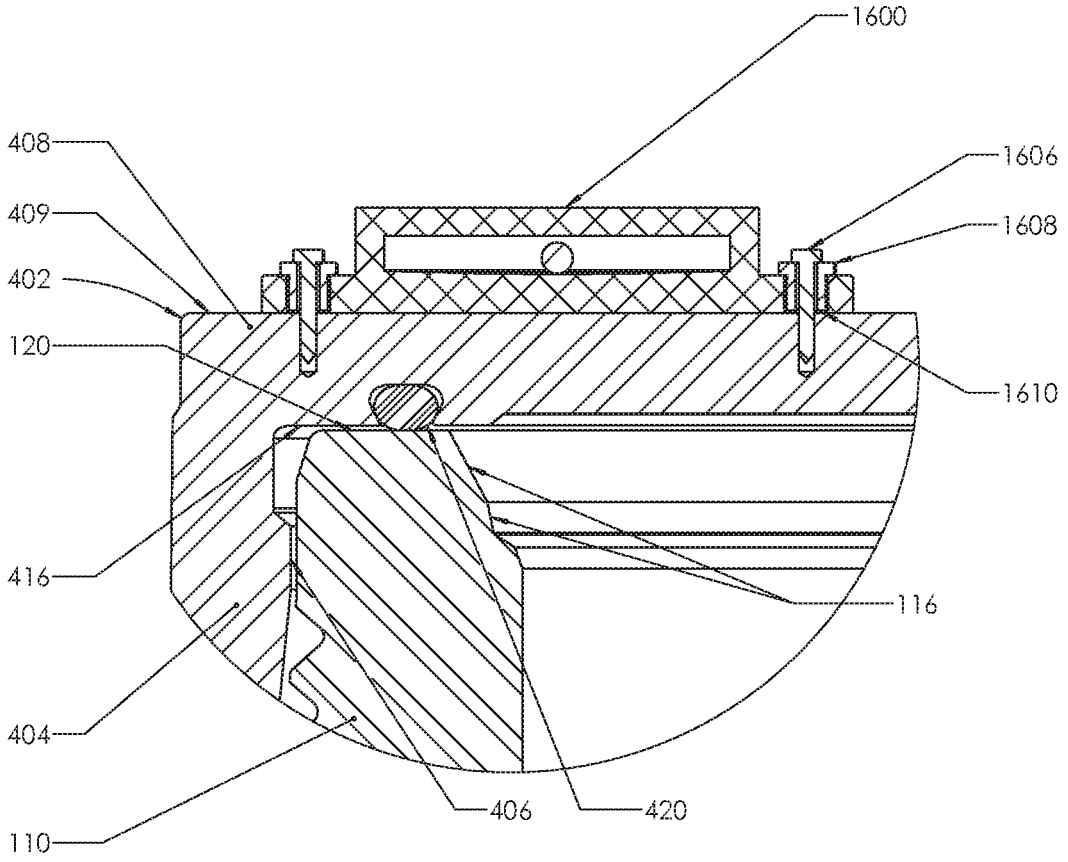
FIG. 16 illustrates an enlarged cross sectional view of an example subsea level indicator mounted to a top plate surface of the protective cap body of the protector cap assembly, according to one or more embodiments of the disclosure.
Figure 17:
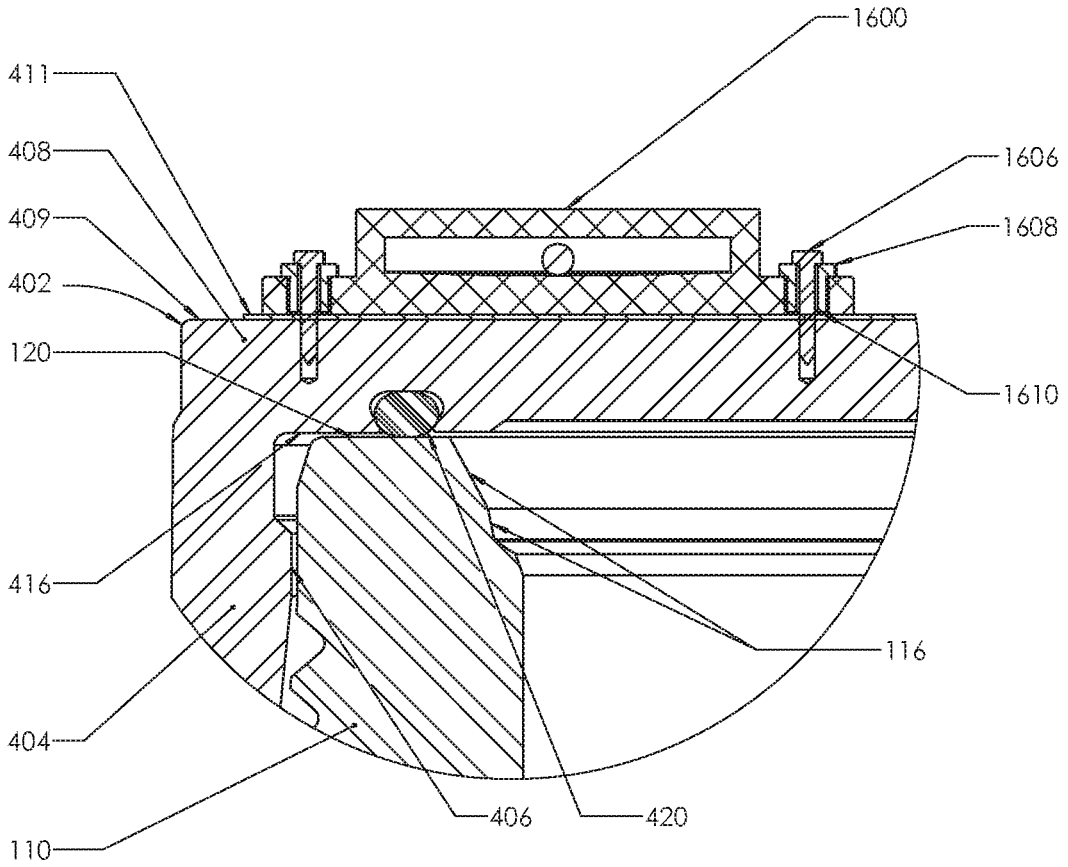
FIG. 17 illustrates an enlarged cross sectional view of the subsea level indicator mounted indirectly to a top surface of the protective cap body via a protective disk, according to one or more embodiments of the disclosure.

In one or more embodiments, to reduce operator costs to perform wellhead and tree angle surveys, the protective cap assembly 400 may include a subsea level indicator 1600 as shown in FIGS. 4-7, 16, and 17. FIG. 16 illustrates an enlarged cross sectional view of the subsea level indicator 1600 mounted directly to a top surface 409 of the top plate 408 of the protective cap assembly 400, according to one or more embodiments of the disclosure. In another embodiment in FIG. 17, FIG. 17 illustrates an enlarged cross sectional view of the subsea level indicator 1600 mounted indirectly to the top plate 408 of the protective cap assembly 400 via a protective disk 411, according to one or more embodiments of the disclosure. As illustrated most clearly in FIGS. 16 and 17, the subsea level indicator 1600 may be a visual bullseye level indicator; however, the disclosure is not limited thereto, as other visual level indicators or electronic level indicators are contemplated within the scope of this disclosure.

The inner surface 416 of the top plate 408 may provide a landing surface for the protective cap assembly 400 on or near the top face 120 of the mandrel 110, thereby providing a stable surface to register the angle of the mandrel 110, whereby the inner surface 416 of the protective cap assembly 400 is substantially parallel to the top face 120 of the mandrel 110. The subsea level indicator 1600 may be mounted directly to the top surface 409 of the top plate 408 as shown in FIG. 16. In the other embodiment shown in FIG. 17, the subsea level indicator 1600 may be mounted to the top surface of the protective disc 411, and the protective disc 411 may be mounted to the top surface 409 of the top plate 408. The subsea level indicator 1600 may be mounted to the top plate 408, directly or indirectly via the protective disc 411, by one or more mechanical fasteners, including, but not limited to, screws, bolts, adapter fittings, and spring washers. In one or more embodiments, the subsea level indicator 1600 may be mounted to the top plate 408 via a plurality of screws 1606 and adapter fittings 1608. In at least one embodiment, spring washers 1010 in conjunction with the mechanical fasteners (e.g., the screws 1606 and fittings 1608) to provide electrical continuity for each screw 1606 and adapter fitting 1608 to the protective disc 411 to avoid corrosion of the screw 1606.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

I claim:

1. A protective cap assembly for a subsea equipment mandrel or hub disposed in a subsea environment, comprising:

a protective cap body comprising a top plate defining an inner surface;

a cylindrical sidewall coupled to or integral with the top plate and having an inner cylindrical surface configured to be disposed over the mandrel or hub;

a primary inlet port defined by the protective cap body and configured to fluidly communicate with a fluid source;

a first annular groove defined by the upper portion of the protective cap body outwards or below the primary inlet port;

a secondary inlet port defined by the protective cap body outwards or below the first annular groove;

a second annular groove defined by the cylindrical sidewall below the secondary inlet port; and one or more secondary outlet ports defined by the cylindrical sidewall above the second annular groove;

a primary seal disposed in the first annular groove to sealingly engage the mandrel or hub and configured to isolate an internal bore of the mandrel or hub from the subsea environment, the primary seal and the top plate as disposed on the mandrel or hub forming at least in part a primary chamber fluidly coupled with the primary inlet port and configured to receive the internal bore therein;

a secondary seal disposed in the second annular groove to sealingly engage the mandrel or hub and configured to isolate a plurality of circumferential grooves formed in an outer circumferential surface of the mandrel from the subsea environment, the primary seal, the secondary seal, and the inner cylindrical surface as disposed over the outer circumferential surface defining at least in part a secondary chamber configured to receive the plurality of circumferential grooves therein;

a primary inlet check valve fluidly coupled to the primary inlet port and configured to selectively prevent fluid from entering the primary chamber from the fluid source;

one or more locking assemblies mounted to the protective cap body to couple the protective cap assembly to the subsea equipment mandrel or hub; and a primary outlet check valve fluidly coupled to the primary chamber and configured to selectively prevent fluid from exiting the primary chamber, wherein the primary chamber and the secondary chamber are configured to fluidly communicate, and the secondary chamber is configured to fluidly communicate with the external subsea environment, such that a portion of the fluid removable from the primary chamber is directed to the secondary chamber, and a portion of the fluid removable from the secondary chamber is dischargeable to the subsea environment.

2. The protective cap assembly of claim 1, wherein:

the inner surface of the top plate defines the first annular groove; and the primary seal is configured to contact a top face of the mandrel or hub in a sealing relationship therewith.

3. The protective cap assembly of claim 1, wherein:

the inner cylindrical surface of the cylindrical sidewall defines the first annular groove; and the primary seal is configured to contact the outer circumferential surface of the mandrel or hub in a sealing relationship therewith.

4. The protective cap assembly of claim 1, wherein the primary outlet check valve is configured to selectively fluidly couple the primary chamber and the secondary chamber, and the primary outlet check valve further comprises:

a valve body coupled to a valve closure having threads, the valve body and the valve closure as coupled defining a valve chamber;

a biasing member disposed in the valve chamber;

a piston axially displaceable in the valve chamber via the biasing member and configured to allow fluid to flow through the primary outlet check valve once a pressure applied thereto exceeds a predetermined pressure;

a threaded adjusting component disposed at least partly in the valve chamber and configured to set the predetermined pressure for which the piston allows fluid to flow through the primary outlet check valve; and a threaded locking component configured to prevent the threaded adjusting component from moving once the predetermined pressure is exceeded.

5. The protective cap assembly of claim 1, further comprising a vent pipe assembly disposed within the primary chamber and configured to provide a flowpath for the removal of a portion of the fluid from the primary chamber.

6. The protective cap assembly of claim 5, wherein the vent pipe assembly includes a main vent pipe and a vent pipe extension coupled thereto, the vent pipe extension being configured to be removed during transport of the protective cap assembly.

7. The protective cap assembly of claim 1, further comprising a valve assembly actuated by a remotely operative vehicle ("ROV"), the valve assembly being fluidly coupled with the primary outlet check valve and the secondary inlet port and configured to selectively direct fluid dischargeable from the primary chamber to either the secondary chamber or directly to the subsea environment.

8. A protective cap assembly for a subsea equipment mandrel or hub disposed in a subsea environment, comprising:

a protective cap body comprising a top plate defining an inner surface;

a cylindrical sidewall coupled to or integral with the top plate and having an inner cylindrical surface configured to be disposed over the mandrel or hub; and a primary inlet port defined by the protective cap body and configured to fluidly communicate with a fluid source;

a primary seal mounted to the protective cap body outwards or below the primary inlet port and configured to sealingly engage the mandrel or hub while isolating an internal bore of the mandrel or hub from the external subsea environment, the primary seal and the top plate as disposed on the mandrel or hub forming at least in part a primary chamber fluidly coupled with the primary inlet port and configured to receive the internal bore therein;

a primary inlet check valve fluidly coupled to the primary inlet port and configured to selectively prevent fluid from entering the primary chamber from the fluid source;

one or more locking assemblies mounted to the protective cap body to couple the protective cap assembly to the subsea equipment mandrel or hub; and a primary outlet check valve fluidly coupled to the primary chamber and configured to selectively prevent fluid from exiting the primary chamber, the primary outlet check valve comprising:

a valve body coupled to a valve closure having threads, the valve body and the valve closure as coupled defining a valve chamber;

a biasing member disposed in the valve chamber;

a piston axially displaceable in the valve chamber via the biasing member and configured to allow fluid to flow through the primary outlet check valve once a pressure applied thereto exceeds a predetermined pressure;

a threaded adjusting component disposed at least partly within the valve chamber and configured to set the predetermined pressure for which the piston allows fluid to flow through the primary outlet check valve; and a threaded locking component configured to prevent the threaded adjusting component from moving once the predetermined pressure is determined.

9. The protective cap assembly of claim 8, wherein:

the inner surface of the top plate defines a first annular groove; and the primary seal is disposed in the first annular groove and is configured to contact a top face of the mandrel or hub in a sealing relationship therewith.

10. The protective cap assembly of claim 8, wherein:

the inner cylindrical surface of the cylindrical sidewall defines a first annular groove; and the primary seal is disposed in the first annular groove and is configured to contact an outer circumferential surface of the mandrel or hub in a sealing relationship therewith.

11. The protective cap assembly of claim 8, further comprising:

a secondary inlet port in the protective cap body outwards or below the primary seal;

a second annular groove defined by the inner cylindrical surface of the protective cap body below the secondary inlet port;

one or more secondary outlet ports defined by the protective cap body above the second annular groove; and a secondary seal disposed in the second annular groove to sealingly engage the mandrel or hub and configured to isolate a plurality of circumferential grooves formed in an outer circumferential surface of the mandrel or hub from the subsea environment, the primary seal, the secondary seal, and the inner cylindrical surface as disposed on the outer circumferential surface defining at least in part a secondary chamber configured to receive the plurality of circumferential grooves therein, wherein the primary chamber and the secondary chamber are configured to fluidly communicate, and the secondary chamber is configured to fluidly communicate with the external subsea environment, such that a portion of the fluid removable from the primary chamber is directed to the secondary chamber; and a portion of the fluid removable from the secondary chamber is dischargeable to the external subsea environment.

12. The protective cap assembly of claim 8, further comprising:

a secondary inlet port in the protective cap body outwards or below the primary seal;

a second annular groove defined by the inner cylindrical surface of the protective cap body below the secondary inlet port;

one or more secondary outlet ports defined by the protective cap body above the second annular groove;

one or more tertiary inlet ports defined by the protective cap body below the second annular groove; and a secondary seal disposed in the second annular groove to sealingly engage the mandrel or hub and configured to isolate a plurality of circumferential grooves formed in an outer circumferential surface of the mandrel or hub from the subsea environment, the primary seal, the secondary seal, and the inner cylindrical surface as disposed on the outer circumferential surface defining at least in part a secondary chamber configured to receive the plurality of circumferential grooves therein, the secondary seal and the inner cylindrical surface as disposed on the outer circumferential surface of the mandrel defining at least in part an annular cavity that is open at the bottom to the external subsea environment, wherein the primary chamber and the secondary chamber are configured to fluidly communicate, the secondary chamber and the annular cavity are further configured to fluidly communicate, with the annular cavity being open at the bottom to the external subsea environment, such that a portion of the fluid removable from the primary chamber is directed to the secondary chamber, a portion of the fluid removable from the secondary chamber is directed to the annular cavity, and a portion of the fluid removable from the annular cavity is dischargeable to the external subsea environment.

13. The protective cap assembly of claim 8, further comprising a spring-biased indicator rod assembly coupled to the top plate and configured to provide a visual indication that the protective cap assembly is in proximal contact with a top face of the mandrel or hub, the indicator rod assembly comprising an indicator body having a longitudinal axis and a threaded lower end portion coupled to the top plate and disposed within a port defined by and extending through the top plate, an inner circumferential surface of the indicator body defining an indicator body chamber;

a lower piston disposed within the indicator body chamber and configured to engage the top face of the mandrel or hub;

an upper piston coupled to or integral with the lower piston and configured to be displaced along the longitudinal axis; and a biasing member disposed about the lower piston and arranged to bias the lower piston downward, such that the upper piston contacts the second upper end portion of the indicator body, wherein the upper piston is configured to be displaced upward and away from the second end portion of the indicator body as the lower piston is brought into contact with the top face of the mandrel, thereby providing visual indication of the protective cap assembly being in proximal contact with the top face of the mandrel or hub.

14. A protective cap assembly of claim 8, further comprising a gas valve assembly including a valve assembly actuated by a remotely operation vehicle ("ROV"), the valve assembly being fluidly coupled with a check valve and fluidly coupled in turn to the primary chamber, the ROV actuated valve assembly configured to selectively enable venting of gas from the primary chamber to the subsea environment via the gas valve assembly when the gas pressure exceeds a predetermined opening pressure of the check valve and the ROV actuated valve assembly is enabled.

15. The protective cap assembly of claim 8, further comprising:

a vent pipe assembly disposed within the primary chamber and configured to enable a portion of the fluid to exit the primary chamber, the vent pipe assembly comprising a main vent pipe and a vent pipe extension configured to couple thereto, the vent pipe extension being configured to be removed during transport of the protective cap assembly; and a storage tube assembly coupled to the protective cap body of the protective cap assembly, the storage tube assembly comprising:

an upper tube comprising an upper tube first end portion and an upper tube second end portion;

a lower tube comprising a lower tube first end portion and a lower tube second end portion, the lower tube second end portion coupled to a lower tube end closure;

a central adapter fitting inserted in a threaded port defined by the top plate and threadingly coupled thereto, the central adapter fitting defining a first socket configured to receive the upper tube second end portion and a second socket configured to receive the lower tube first end portion, the lower tube and upper tube coupled with one another via the central fitting, and configured to define a cavity which may house the vent pipe extension when detached from the protective cap assembly;

a closure configured to couple with the upper tube first portion during transport of the protective cap assembly; and a plug configured to couple with the threaded port defined by the top plate to seal the threaded port after the storage tube assembly is removed from the cap.

16. The protective cap assembly of claim 8, further comprising a subsea level indicator coupled with a top surface of the top plate of the protective cap body and configured to provide an indication of the angular orientation of the top plate and a top face of the mandrel or hub.

17. The protective cap assembly of claim 8, further comprising a subsea level indicator coupled to a top surface of a protective metal disk, the protective metal disc mounted to a top surface of the top plate of the protective cap body and configured to provide an indication of the angular orientation of the top plate and a top face of the mandrel or hub.

18. A protective cap assembly configured to be coupled to a subsea equipment mandrel or hub disposed in a subsea environment, the protective cap comprising:

a protective cap body comprising:

a top plate defining an inner surface;

a cylindrical sidewall coupled to or integral with the top plate, wherein the cylindrical sidewall is configured to be disposed over the mandrel or hub;

a primary inlet port defined by the protective cap body and configured to fluidly communicate with a fluid source;

a secondary inlet port defined by an upper portion of the protective cap body and outwards or below the primary inlet port;

a first annular groove defined by an inner cylindrical surface of the cylindrical sidewall of the protective cap body and below the secondary inlet port; and one or more secondary outlet ports defined by the cylindrical sidewall above the first annular groove;

a primary seal mounted internally to the protective cap body outwards or below the primary inlet port and inwards or above the secondary inlet port and configured to sealingly engage the mandrel or hub and to isolate an internal bore of the mandrel or hub from the external subsea environment, the primary seal and the top plate as disposed on the mandrel or hub forming at least in part a primary chamber fluidly coupled to the primary inlet port and configured to receive the internal bore of the mandrel or hub therein;

a primary inlet check valve fluidly coupled to the primary inlet port and configured to selectively prevent fluid from entering the primary chamber from the fluid source;

one or more locking assemblies mounted to the protective cap body to couple the protective cap assembly to the mandrel or hub; and a secondary seal disposed in the first annular groove and configured to isolate a plurality of circumferential grooves formed in an outer circumferential surface of the mandrel from the external subsea environment, the primary seal, the secondary seal, and the inner cylindrical surface as disposed on the outer circumferential surface defining at least in part a secondary chamber configured to receive the plurality of circumferential grooves therein, wherein the primary chamber and the secondary chamber are configured to fluidly communicate, and the secondary chamber is configured to fluidly communicate with the external subsea environment via the one or more secondary outlet ports, such that a portion of the fluid removable from the primary chamber is directed to the secondary inlet port of the secondary chamber; and a portion of the fluid removable from the secondary chamber is dischargeable to the external subsea environment.

19. The protective cap assembly of claim 18, wherein:

the inner surface of the top plate defines a second annular groove;

the primary seal is disposed in the second annular groove and configured to contact a top face of the mandrel in a sealing relationship therewith.

20. The protective cap assembly of claim 18, wherein:

the inner cylindrical surface of the cylindrical sidewall defines a second annular groove;

the primary seal is disposed in the second annular groove and configured to contact the outer circumferential surface of the mandrel in a sealing relationship therewith.

21. The protective cap assembly of claim 18, wherein a primary outlet check valve is fluidly coupled to the primary chamber and configured to selectively prevent fluid from exiting the primary chamber, the primary outlet check valve comprising:

a valve body coupled to a valve closure having threads, the valve body and the valve closure as coupled defining a valve chamber;

a biasing member disposed in the valve chamber;

a piston axially displaceable in the valve chamber via the biasing member and configured to allow fluid to flow through the primary outlet check valve once a pressure applied thereto exceeds a predetermined pressure;

a threaded adjusting component disposed at least partly within the valve chamber and configured to set the predetermined pressure for which the piston allows fluid to flow through the primary outlet check valve; and a threaded locking component configured to prevent the threaded adjusting component from moving once the predetermined pressure is determined.

22. A protective cap assembly for a subsea equipment mandrel or hub disposed in a subsea environment, comprising:

a protective cap body comprising:

a top plate defining an inner surface;

a cylindrical sidewall coupled to or integral with the top plate, wherein the cylindrical sidewall is configured to be disposed over the mandrel or hub;

a primary inlet port defined by the protective cap body and configured to fluidly communicate with a fluid source;

a secondary inlet port defined by an upper portion of the protective cap body and outwards or below the primary inlet port;

a first annular groove defined by an inner cylindrical surface of the cylindrical sidewall of the protective cap body and below the secondary inlet port; and one or more secondary outlet ports defined by the cylindrical sidewall above the first annular groove;

one or more tertiary inlet ports defined by the cylindrical sidewall below the first annular groove;

a primary seal mounted internally to the protective cap body outwards or below the primary inlet port and inwards or above the secondary inlet port and configured to sealingly engage the mandrel or hub and to isolate an internal bore of the mandrel or hub from the external subsea environment, the primary seal and the top plate as disposed on the mandrel or hub forming at least in part a primary chamber fluidly coupled to the primary inlet port and configured to receive the internal bore of the mandrel or hub therein;

a primary inlet check valve fluidly coupled to the primary inlet port and configured to selectively prevent fluid from entering the primary chamber from the fluid source;

one or more locking assemblies mounted to the protective cap body to couple the protective cap assembly to the mandrel or hub; and a secondary seal disposed in the first annular groove and configured to isolate a plurality of circumferential grooves formed in an outer circumferential surface of the mandrel from the external subsea environment, the primary seal, the secondary seal, and the inner cylindrical surface as disposed on the outer circumferential surface defining at least in part a secondary chamber configured to receive the plurality of circumferential grooves therein, the secondary seal and the inner cylindrical surface as disposed on the outer circumferential surface of the mandrel defining at least in part an annular cavity having a top portion and a bottom portion, the bottom portion of the annular cavity being open to the external subsea environment, and the top portion of the annular cavity being enclosed by the secondary seal, wherein the primary chamber and the secondary chamber are configured to fluidly communicate, the secondary chamber and the annular cavity are configured to fluidly communicate, with the annular cavity being open at the bottom to the external subsea environment, such that a portion of the fluid removable from the primary chamber is directed to the secondary chamber, a portion of the fluid removable from the secondary chamber is directed to the annular cavity, and a portion of the fluid removable from the annular cavity is dischargeable to the external subsea environment.

23. The protective cap assembly of claim 22, wherein:

the inner surface of the top plate defines a second annular groove;

the primary seal is disposed in the second annular groove and configured to contact a top face of the mandrel in a sealing relationship therewith.

24. The protective cap assembly of claim 22, wherein:

the inner cylindrical surface of the cylindrical sidewall defines a second annular groove;

the primary seal is disposed in the second annular groove and configured to contact the outer circumferential surface of the mandrel in a sealing relationship therewith.

25. The protective cap assembly of claim 22, wherein a primary outlet check valve is fluidly coupled to the primary chamber and configured to selectively prevent fluid from exiting the primary chamber, the primary outlet check valve comprising:

a valve body coupled to a valve closure having threads, the valve body and the valve closure as coupled defining a valve chamber;

a biasing member disposed in the valve chamber;

a piston axially displaceable in the valve chamber via the biasing member and configured to allow fluid to flow through the primary outlet check valve once a pressure applied thereto exceeds a predetermined pressure;

a threaded adjusting component disposed at least partly within the valve chamber and configured to set the predetermined pressure for which the piston allows fluid to flow through the primary outlet check valve; and a threaded locking component configured to prevent the threaded adjusting component from moving once the predetermined pressure is determined.

* * * * *